US009795163B2

(12) United States Patent
Kaljura et al.

(10) Patent No.: US 9,795,163 B2
(45) Date of Patent: Oct. 24, 2017

(54) SMOKING ARTICLE

(71) Applicant: British American Tobacco (Investments) Limited, London (GB)

(72) Inventors: Karl Kaljura, London (GB); Philip Russell Fawcus, London (GB); Stuart Dunlop, London (GB); Adrian Mordue, London (GB); Ian Dunckley, London (GB); Nick Harding, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 14/654,767

(22) PCT Filed: Dec. 12, 2013

(86) PCT No.: PCT/GB2013/053268
§ 371 (c)(1),
(2) Date: Jun. 22, 2015

(87) PCT Pub. No.: WO2014/096782
PCT Pub. Date: Jun. 26, 2014

(65) Prior Publication Data

US 2015/0335067 A1 Nov. 26, 2015

(30) Foreign Application Priority Data

Dec. 21, 2012 (GB) ..... 1223179.1

(51) Int. Cl.
*A24D 3/00* (2006.01)
*A24D 3/04* (2006.01)

(52) U.S. Cl.
CPC ..... *A24D 3/041* (2013.01); *A24D 3/043* (2013.01)

(58) Field of Classification Search
None
See application file for complete search history.

(56) References Cited

U.S. PATENT DOCUMENTS 3,359,988 A 12/1967 Thomson
3,503,406 A 3/1970 Riegel et al.
3,512,537 A 5/1970 Pelletier
(Continued)

FOREIGN PATENT DOCUMENTS

CN 2807809 Y 8/2006
DE 3904948 C1 5/1990
(Continued)

OTHER PUBLICATIONS

International Search Report and Written Opinion, mailed Sep. 17, 2014 for PCT/GB2013/053268, filed Dec. 12, 2013.
(Continued)

*Primary Examiner* — Michael J Felton
(74) *Attorney, Agent, or Firm* — Cantor Colburn LLP

(57) ABSTRACT

A smoking article, comprises a first and a second engaging surface (233*a*, 233*b*) spaced circumferentially, and a control element (250) movable between the first and second engaging surfaces. A ventilation area (270) is configured to be selectively covered by the movable control element. The control element comprises a first limiting edge configured to engage with the first engaging surface and a second limiting edge configured to engage with the second engaging surface to limit rotational movement.

29 Claims, 21 Drawing Sheets

(56) References Cited

U.S. PATENT DOCUMENTS

| | | | |
|---|---|---|---|
| 3,577,996 | A | 5/1971 | Sherrill |
| 3,628,540 | A | 12/1971 | Sherrill |
| 3,638,661 | A | 2/1972 | Pinkham |
| 3,789,855 | A | 2/1974 | Norman |
| 4,273,141 | A | 6/1981 | Jan Van Tilburg |
| 4,527,573 | A | 7/1985 | Hausermann |
| 4,564,030 | A | 1/1986 | Jessup et al. |
| 4,576,187 | A | 3/1986 | Deal |
| 4,593,707 | A | 6/1986 | Seidel et al. |
| 4,601,298 | A | 7/1986 | Nichols et al. |
| 4,649,941 | A | 3/1987 | Norman |
| 4,649,943 | A | 3/1987 | Gonterman |
| 4,649,945 | A | 3/1987 | Norman et al. |
| 4,687,008 | A | 8/1987 | Houck, Jr. et al. |
| 4,687,009 | A | 8/1987 | Nichols |
| 4,699,158 | A | 10/1987 | Sprinkel, Jr. |
| 4,700,725 | A | 10/1987 | Geiszler, Jr. |
| 4,716,912 | A | 1/1988 | Leonard |
| 4,718,437 | A | 1/1988 | Luke |
| 4,727,892 | A | 3/1988 | Abdelgawad |
| 4,809,718 | A | 3/1989 | Deal |
| 4,834,117 | A | 5/1989 | Braem et al. |
| 4,848,375 | A | 7/1989 | Patron et al. |
| 2007/0074735 | A1 | 4/2007 | Gaworski |
| 2007/0095357 | A1 | 5/2007 | Besso et al. |
| 2011/0232663 | A1 | 9/2011 | Kadiric et al. |

FOREIGN PATENT DOCUMENTS

| | | | |
|---|---|---|---|
| EP | 0228211 | A1 | 7/1987 |
| EP | 0260789 | A1 | 3/1988 |
| EP | 0476969 | A1 | 3/1992 |
| EP | 2033531 | A1 | 3/2009 |
| GB | 938902 | A2 | 10/1963 |
| GB | 1264700 | A | 2/1972 |
| WO | 2006027437 | A1 | 3/2006 |
| WO | 2011039302 | A1 | 4/2011 |
| WO | 2011051115 | A1 | 5/2011 |
| WO | 2011121327 | A1 | 10/2011 |
| WO | 2011121328 | A2 | 10/2011 |
| WO | 2012123723 | A1 | 9/2012 |
| WO | 2013024263 | A1 | 2/2013 |
| WO | 2013045912 | A1 | 4/2013 |
| WO | 2013045914 | A1 | 4/2013 |

OTHER PUBLICATIONS

UKIPO Search Report, mailed May 3, 2013 for Application No. GB1223179.1, filed Dec. 21, 2012.

International Preliminary Report on Patentability, mailed Dec. 12, 2012 for PCT/GB2013/053268, filed Dec. 12, 2013.

Search Report, mailed May 3, 2013 for UK Application No. GB1223183.3, filed Dec. 21, 2012.

International Search Report and Written Opinion, mailed Sep. 16, 2014, for International Application No. PCT/GB2013/053266, filed Dec. 12, 2013.

International Search Report and Written Opinion, mailed Sep. 17, 2014, for International Application No. PCT/GB2013/053265, filed Dec. 12, 2013.

International Preliminary Report on Patentability, mailed Feb. 2, 2015 for International Application No. PCT/GB2013/053265, filed Dec. 12, 2013.

International Search Report and Written Opinion, dated Sep. 16, 2014 for PCT/GB2013/053269, filed Dec. 12, 2013.

International Preliminary Report on Patentability, mailed Dec. 21, 2012, for PCT/GB2013/053269, filed Dec. 12, 2013.

SMOKING ARTICLE

CLAIM FOR PRIORITY

This application is the National Stage of International Application No. PCT/GB2013/053268, filed Dec. 12, 2013, which in turn claims priority to and benefit of United Kingdom Patent Application No. GB1223179.1, filed Dec. 21, 2012. The entire contents of the aforementioned applications are herein expressly incorporated by reference.

TECHNICAL FIELD

Embodiments of the invention relate to a smoking article, a blank for manufacturing a smoking article, and a method of manufacturing a smoking article.

BACKGROUND

Smoking articles are known in which a ventilation can be controlled by rotation of a part of the smoking article.

SUMMARY

In this specification there are described embodiments of a smoking article, comprising: a first and a second engaging surface spaced circumferentially, a control element movable between the first and second engaging surfaces, and a ventilation area configured to be selectively covered by the movable control element, wherein the control element comprises a first limiting edge configured to engage with the first engaging surface and a second limiting edge configured to engage with the second engaging surface to limit rotational movement, and the control element is substantially impermeable to ventilating air between the first and second limiting edges, and the smoking article is configured such that the relative circumferential position of the control element between the first and second engaging surfaces determines a level of ventilation of the smoking article, wherein the amount of ventilation area covered by the control element directly determines the ventilation level of the smoking article.

In a further embodiment, there is described a smoking article comprising: a ventilation mechanism configured to select a ventilation level of the smoking article by movement of a first part relative to a second part of the smoking article, and a limiting mechanism configured to limit movement of the first part relative to the second part of the smoking article, wherein the ventilation mechanism and limiting mechanism are in a single control element.

In a further embodiment, there is described a blank configured to be wrapped around one or more rod articles in the manufacture of a smoking article, the blank comprising: a first and a second engaging surface spaced circumferentially, a control element movable between the first and second engaging surfaces, and a ventilation area configured to be selectively covered by the movable control element, wherein the control element comprises a first limiting edge configured to engage with the first engaging surface and a second limiting edge configured to engage with the second engaging surface to limit rotational movement, and the control element is substantially impermeable to ventilating air between the first and second limiting edges, and the blank is configured such that the relative circumferential position of the control element between the first and second engaging surfaces determines a level of ventilation of the smoking article, wherein the amount of ventilation area covered by the control element directly determines the ventilation level of the smoking article.

In a further embodiment, there is described a method of manufacturing a smoking article comprising: providing one or more rod articles, wrapping at least one blank around the rod articles, wherein the at least one blank comprises: a first and a second engaging surface spaced circumferentially, a control element movable between the first and second engaging surfaces, and a ventilation area configured to be selectively covered by the movable control element, wherein the control element comprises a first limiting edge configured to engage with the first engaging surface and a second limiting edge configured to engage with the second engaging surface to limit rotational movement, and the control element is substantially impermeable to ventilating air between the first and second limiting edges, and the blank is configured such that the relative circumferential position of the control element between the first and second engaging surfaces determines a level of ventilation of the smoking article, wherein the amount of ventilation area covered by the control element directly determines the ventilation level of the smoking article.

In a further embodiment, there is described a smoking article in which a first part is movable relative to a second part in a range determined by a control element, the control element further arranged to variably cover a ventilation area to determine a ventilation of the smoking article.

BRIEF DESCRIPTION OF THE DRAWINGS

Various embodiments of the invention will now be described, by way of example only, with reference to the accompanying drawings, in which.

DETAILED DESCRIPTION

As used herein, the term "smoking article" includes smokable products such as cigarettes, cigars and cigarillos whether based on tobacco, tobacco derivatives, expanded tobacco, reconstituted tobacco or tobacco substitutes and also heat-not-burn products (i.e. products in which flavour is generated from a smoking material by the application of heat without causing combustion of the material).

A smoking article formed by an embodiment of the apparatus or method comprises an elongate source of smokable material. In particular, the smokable material is tobacco, and is arranged in a cylindrical tobacco rod. One or more fillers or filter sections are attached to the tobacco rod. Each filter or filter section comprises filtration material wrapped in a sheet material, for example, paper, e.g. plugwrap. The filter or filter sections define a longitudinal axis, which is common to a longitudinal axis of the tobacco rod. As used herein, the term "component of a smoking article" or "rod article" includes any component part of a smoking article such as a tobacco rod, filter, filter section or mouthpiece, or a combination of these. One or more components of the smoking article are circumscribed by a wrap. The wrap can have the function of one or more of: connecting two components, providing structural support to one or more components, allowing movement relative to another part of the smoking article to control a property of the smoking article (e.g. ventilation), or any other function.

Figure 1:
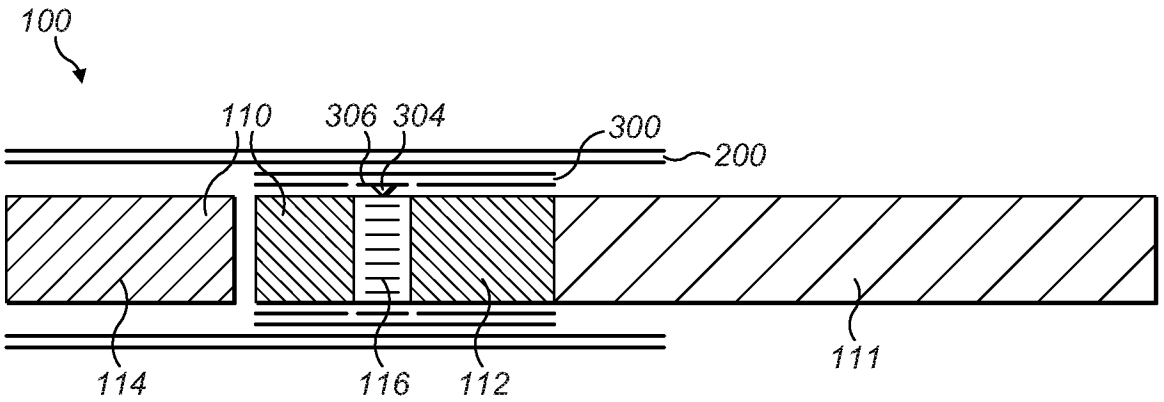
FIG. 1 is a partial longitudinal cross-section of a smoking article according to an exemplary embodiment of the invention.

FIG. 1 shows an exemplary smoking article 100, which can be manufactured according to an embodiment of the apparatus or method. This smoking article is merely an example, and the apparatus and method may be used in the manufacture of different types of smoking articles having a first wrapped layer, and a second wrapped layer circumscribing the first wrapped layer.

The smoking article 100 comprises a first part comprising a source of smokable material 111. In this example, the smokable material is tobacco, in the form of a tobacco rod. The smoking article 100 further comprises one or more filter sections attached to the source of smokable material 111. The exemplary smoking article comprises a part movable to select a property of the smoking article e.g. a ventilation level. In this example, the movement is a rotation. In some implementations, the smoking article optionally comprises a limiter (limiting mechanism), configured to limit movement to a pre-determined range.

The smoking article comprises a first filter section 112 and a second filter section 114. The first filter section 112 is attached to the source of smokable material to form a single unit. The tobacco rod and first filter section 112 may be connected with a covering layer to affix the first filter section 112 to the tobacco rod, for example formed of sheet material, e.g. tipping paper, as is known. In some examples, the first filter section 112 comprises an additive, for example, carbon. In some examples, the additive can be activated charcoal.

The tobacco rod and first filter section are referred to as a first part of the smoking article, or as a tobacco unit, and in some examples, are rigidly connected as a unit. The elongate tobacco rod and first filter section define a longitudinal axis of the smoking article. A rearward direction is defined towards a mouth end of the smoking article, and a forward direction is defined towards a tobacco, or lighting, end of the smoking article.

A second part of the smoking article comprises the second filter section 114. The second filter section 114 is co-axial with the first filter section 112, and is located rearwardly of the first filter section 112. The tobacco rod, first filter section 112 and second filter section 114 can be considered as examples of rod articles 110 or a "core" of the smoking article, around which an inner wrap and an outer wrap are wrapped. The smoking article may be formed with one or more rod articles. The tobacco rod and first filter section are configured to rotate as a unit around a longitudinal axis.

The first and/or second filter sections 112,114 are made of a conventional filtration material, e.g. cellulose acetate tow. The first and/or second filter sections 112,114 further comprises a sheet material, for example paper, e.g. plugwrap, which is wrapped around the filtration material. The filtration material and surrounding wrapped sheet material forms an example of a rod article. The first and second and further wraps described are separate and additional to the sheet material wrapped directly around the filtration material or tobacco material, and forming the filter rods or tobacco rod.

The smoking article 100 comprises a plurality of layers extending around one or more rod article. Each layer can be in the shape of a cylindrical tube, extending around the circumference of the tobacco rod 111, first filter section 112 and/or second filter section 114. The plurality of layers can be formed by one or more blanks of sheet material, wrapped around the rod articles one or more times. In a first embodiment of the invention, a first blank 300 is wrapped directly around the rod articles. A second blank 200 is wrapped around the first blank 300. In this example, each of the first and second blanks 300,200 is wrapped twice around the rod articles 110. In this implementation, the first blank 300 and a rod article 110 (e.g. first filter section 112 as shown) comprise, or have attached, an indexing mechanism 116, 304, which will be described in more detail below.

Figure 2:
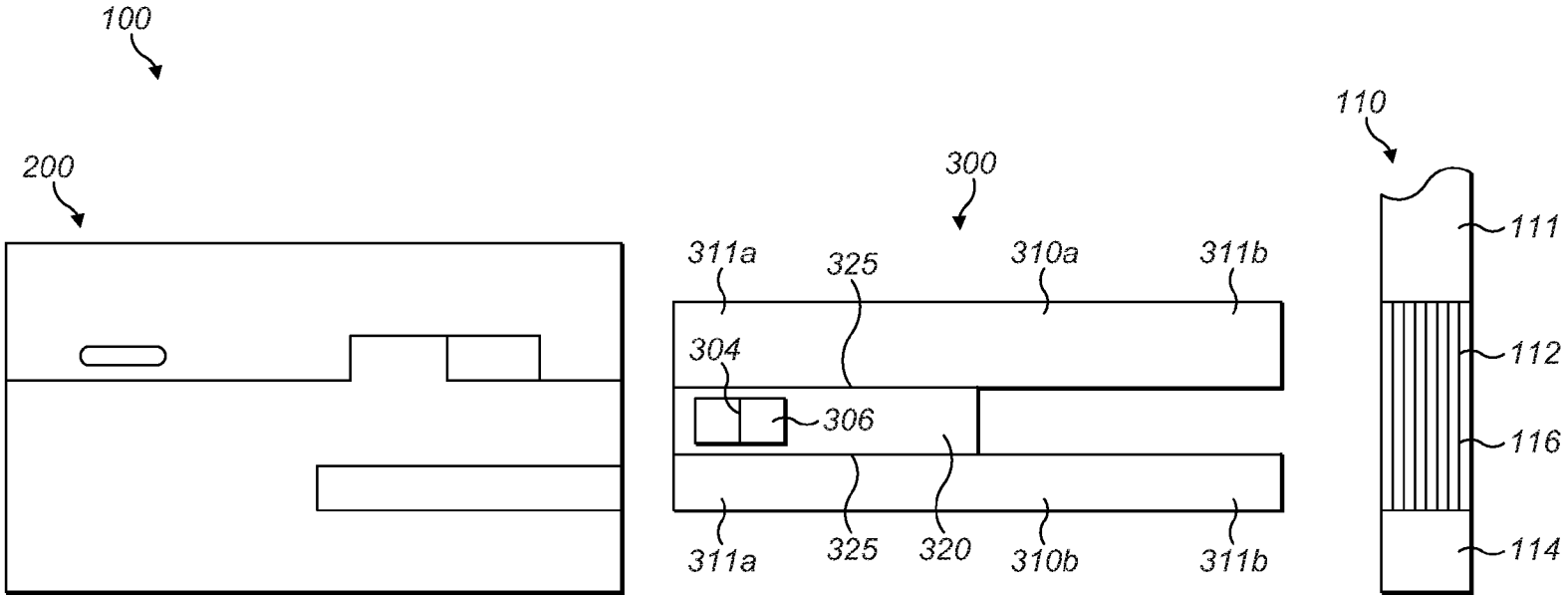
FIG. 2 is a plan view of blanks and rod articles according to a first embodiment of the smoking article.

FIG. 2 shows the rod articles 110, as described with respect to FIG. 1. The first blank 300 and second blank 200 are also shown. The alignment of the first and second blanks 300,200, and the rod articles 110, indicates the attachment of the relevant part of the first blank 300 to the rod articles, and of the second blank 200 to the first blank 300. The first and second blanks 300,200 are each made of a sheet material. In some aspects, the sheet material is paper. The first and second blanks 300,200 are each unitary sheets of material. The first and second blanks 300,200 each extend in a plurality of layers around the whole circumference of the smoking article.

The indexing mechanism comprises a first indexing surface 116 engagable with a second indexing surface 304 configured to move relative to each other with an indexing movement between discrete positions. In some aspects, the indexing can generate an audible click when moved between indexing positions.

The first indexing surface comprises ridges and grooves (depressions) 116 on the exterior surface of the first filter section. The ridges and grooves are arranged such that circumferential movement is indexed. In some examples, the ridges and grooves 116 extend substantially longitudinally.

The ridges and grooves 116 are defined by an exterior paper wrap and filtration material which together form the first filter section.

The second indexing surface comprises one or more upstanding protrusions, which extend radially. The one or more protrusions can be in the form of a pawl 304. The pawl comprises a radially protruding ridge, comprising an elongate protrusion extending longitudinally. The pawl 304 is configured to engage with features 116 (e.g. ridges) on an exterior of the rod articles, to provide indexing on rotation between an innermost wrap around the rod articles and at least one of the rod articles, in particular, the first filter section 112.

A second indexing surface support unit, also termed a pawl support unit, 306 comprises the pawl 304. The pawl support unit 306 can be a piece of sheet material which is folded to define the pawl 304. The pawl 304 has a triangular cross-section to protrude radially inwardly. An apex of the triangular cross-section engages with the features 116, e.g. ridges, in the first filter section 112. The pawl support unit 306 comprises a plurality of folds to define the triangular cross-section of the pawl 304.

The pawl support unit 306 extends around only a part of the circumference of the rod articles 110. The pawl support unit 306 is affixed to a support section 320 of the first blank 300. The support section 320 extends around the whole circumference of the rod articles 110. For example, the support section 320 extends around one whole circumference only of the rod articles. The support section 320 wraps around the rod articles 110 in the form of a tube, i.e. a cylindrical tube. The support section 320 is configured to attach to itself, to be secured as a tube extending around the rod article.

The first blank 300 is configured to support the pawl 304 in a radial position which allows the pawl 304 to index between the indexing ridges of the first indexing surface. In particular, the pawl unit 306 is supported radially away from at least a part of the first indexing surface, e.g. radially spaced from a radially inner part of the grooves. As such, the engaged first and second indexing surfaces can be considered as spaced apart, whilst being operable to provide indexed movement.

The first and second indexing surfaces are in a predetermined radial position relative to each other. In some aspects, this radial position is at least a minimum separation. In some aspects, the first and second indexing surfaces are spaced apart such that the first and second indexing surfaces are not urged or biased together, or forced into full contact with each other.

The first blank 300 comprises at least one spacing section configured to maintain a radial position between the first and second indexing surfaces. In some aspects, the first blank 300 comprises first and second spacing sections 310*a*,310*b* configured to maintain this radial position. The first and second spacing sections 310*a*,310*b* are arranged forwardly and rearwardly of the second indexing surface 304, respectively. The first and second spacing sections 310*a*,310*b* each comprise a first portion 311*a* frangibly attached to the support section 320. For example, the blank 300 comprises a plurality of perforations 325 extending circumferentially between the first portions 311*a* and support section 320. The first and second spacing sections 310*a*,310*b* are elongate sections of sheet material affixed to the first filter section. The first and second spacing sections 310*a*,310*b* are spaced apart longitudinally, providing access therebetween to the first indexing surface. In some examples, the first and/or second spacing sections 310*a*,310*b* are attached to parts of the first indexing surface on the first filter section 112. The second indexing surface is arranged to contact a further part of the first indexing surface on the first filter section 112, between the first and second spacing sections 310*a*,310*b*.

The first and second spacing sections 310*a*,310*b* form both an inner layer and outer layer around the rod article 110. As such, the first and second spacing sections 310*a*,310*b* extend two times around the whole circumference of the rod articles. The first portions 311*a* of the spacing sections 310*a*,310*b* and support section 320 are configured to form an outer layer of the blank 300. An inner layer is provided by a second portion 311*b* of the first and second spacing sections 310*a*,310*b*.

The inner layer and outer layer are wrapped sequentially. In particular, the area of the blank for forming the inner layer is wrapped around the whole circumference of the smoking article, i.e. around the rod articles. The outer layer is integrally formed as part of the same blank, and follows the inner layer. The outer layer is wrapped around the whole circumference. In some aspects, a further extent of blank overlaps with the outer layer, to secure the outer layer as a tube. In some aspects, an overlap also secures the inner layer as a tube. The wrapping of the blank is continuous.

The second portions 311*b* are attached directly to the rod article, e.g. the first filter section 112. The pawl support unit 306 is initially attached to the outer layer of the first blank 300, i.e. on the support section 320.

The second blank 200 surrounds the support section and first and second spacing sections 310*a*,310*b*,320. The second blank 200 extends longitudinally over the support section 320 and at least one of the first and second spacing sections 310*a*,310*b*. The second blank 200 is attached to the support section. A part of the second blank also contacts at least one of the first and second spacing sections 310*a*,310*b* to support the support section 320 in a pre-determined radial position relative to the first indexing surface 116. Thus, a layer (e.g. of second blank 200) overlies and contacts an exterior surface of at least one of the first and second spacing sections 310*a*,310*b* to support the support section 320 in a pre-determined radial position relative to the first indexing surface 116. The spacing section provides a spacing of two layers of the sheet material of the blank 300. In some aspects, the overlying layer is a tubular layer of sheet material. For example, a tubular layer surrounds and extends longitudinally over the support section 320 and rearward second spacing section 310*b* only.

The layer providing the support can be the outer layer of the second blank, i.e. outermost layer of the smoking article. The layer providing the support can contact one or more further layers or sections which are affixed to a spacing section. Thus, the section or layer supporting the second indexing surface can contact any suitable radial support, which can be in contact directly with a spacing section, contact with one or more layers affixed to a spacing section, or one or more separate layers affixed to a rod article, e.g. around the second filter section. In some examples, the pawl support section 320 is movable circumferentially within, and/or restrained longitudinally by, the spacing sections 310*a*,310*b*.

Figure 3:
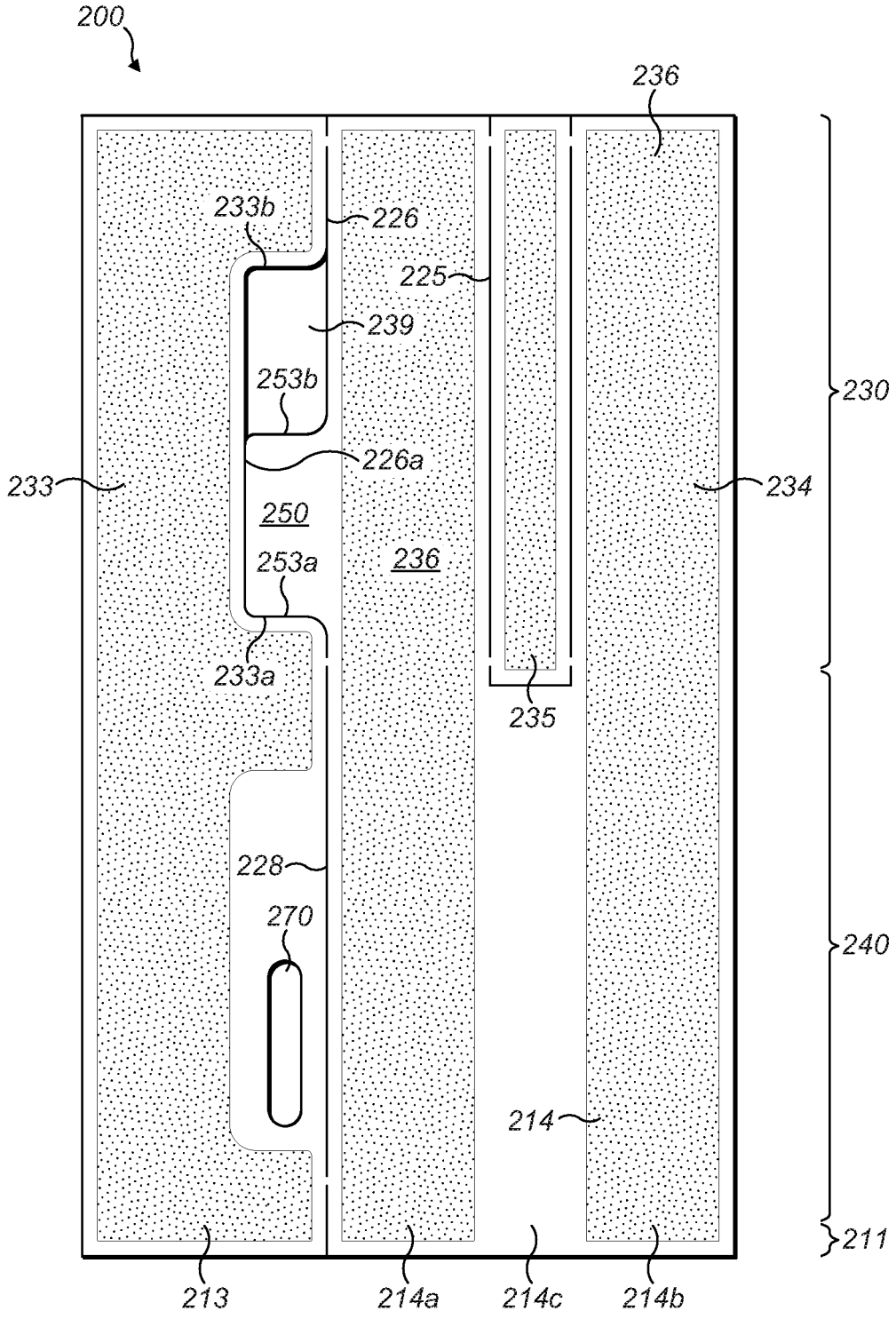
FIG. 3 is a plan view of a blank according to the first embodiment of the smoking article.

FIG. 3 shows a first embodiment of a second blank 200 configured to form part of a smoking article having at least one of the functions stated above. The blank 200 is dimensioned to be wrapped two times around one or more rod articles, to form a first (outer) layer 240 and a second (inner) layer 230. The blank 200 comprises a sheet material, in particular, a single layer of sheet material. For example, the sheet material is paper. The first outer layer 240 and second inner layer 230 each extend around a complete circumference of the rod articles. The blank 200 comprises an overlap section 211 extending circumferentially beyond the first layer 240 to overlap and connect (adhere) with the first layer, and secure the blank 200 as a tube. The second blank 200 is configured to wrap around rod article(s) already wrapped by the first blank 300. The shaded areas of the blanks of any embodiment can indicate the location of adhesive, although adhesive areas may differ from those shown.

The blank 200 comprises a plurality of sections which are part of the first part of the smoking article, and a plurality of sections which are part of the second part of the smoking article. The first part is rotatable relative to the second part to control a property of the smoking article, e.g. ventilation.

On the first (outer) layer 240, a first section 213 is a part of the first part. A second section 214 is part of the second part. On the second (inner) layer 230, a third section 233 and a fourth section 235 is a part of the first part. A fifth section 234, a control element 250 and a control element support section 236 are part of the second part. The functions of these sections will now be described. Alternatively, the second blank 200 can be considered as comprising a first part having the first section 213, third section 233 and fourth section 235. The second part comprises the second section 214, fifth section 234 and control element support section 236. All the sections are initially connected on the single blank 200. The blank 200 can be wrapped as a unit two times around the rod articles. In some aspects, the blank 200 comprises frangible connections to separate sections and allow movement. Sections not separated can remain integral. Each section extends around a whole circumference of the rod articles.

The inner layer and outer layer are wrapped sequentially. In particular, the area of the blank for forming the inner layer is wrapped around the whole circumference of the smoking article, i.e. around the rod articles. The outer layer is integrally formed as part of the same blank, and follows the inner layer. The outer layer is wrapped around the whole circumference. In some aspects, a further extent of blank overlaps with the outer layer, to secure the outer layer as a tube. In some aspects, an overlap also secures the inner layer as a tube. The wrapping of the blank is continuous.

Sections of the second (inner) layer 230 surround and are attached to the rod articles of the first part, e.g. tobacco rod and filter section, e.g. wrapped by the first blank 300. The second (inner) layer 230 surrounds and is attached to the rod articles of the second part e.g. second filter section. For example, the fifth section 234 is attached to the second filter section 114, either directly or through one or more separate spacing layers.

The third section 233, fourth section 235 and control element support section 236 are located around the rod articles of the first part. For example, all these sections 233,235,236 are located around the first filter section. The third section 233 and fourth section 235 are attached to the rod article of the first part, and move with the first filter section. The third section 233 is affixed to the exterior of the forward spacing section 310*a*. The fourth section 235 is affixed to the rearward spacing section 310*b*. As such, the fourth section 235 provides a spacing layer, and in some examples, an exterior of the fourth section provides a contact surface used to support the radial position of the second section. In some aspects, the width of the fourth section is substantially the same as (or less than) the second spacing section 310*b*.

The control element support section 236 is movable around the rod articles of the first part. In particular, the control element support section 236 is moveable circumferentially around the first filter section 112 and/or first indexing surface 116. In some aspects, the control element support section 236 is affixed to the pawl support section 320 on the first blank. Thus, movement of the control element support section 236 is indexed.

The first section 213 is affixed to the underlying third section 233. The second section 214 is affixed to the underlying control element support section 236 over an area 214*a*, and is affixed to the underlying fifth section 234 over an area 214*c*. The second section 214 overlies the fourth section 234 over an area 214*b*, and is not affixed to the fourth section 234.

The second blank 200 is wrapped around the rod articles as a single sheet. All of the sections of the second blank 200 are initially attached to each other, and are separable as described with frangible connections. In some aspects, the second blank 200 comprises a single sheet to which frangible connections are formed to define the different sections. The sections which are not separable by a frangible connection, or cut-out, are considered to remain integrally formed. Thus, the first and third sections 213,233 are integral, and can be considered as a single two-layer wrap. Similarly, the control element support section 236, second section 214 and fifth section 234 are integral, and can be considered as a single two-layer wrap. The control element support section 236 is initially integrally formed with an outer layer, which is wrapped continuously around the control element support section 236.

The second blank 200 comprises sections which are engagable to limit movement between the first and second parts of the smoking article. In some aspects, the third section 233 and control element support section 236 are configured to engage to limit the range of rotation between the first and second parts of the smoking article.

One of the third section and control element support section defines the control element, or tab, 250. In this example, the control element 250 is a part of the control element support section 236. The control element 250 is a portion of the blank which extends longitudinally beyond an adjacent part of the section defining the control element. For example, the control element 250 is an integral part of the control element support section 236 of the blank 200. The control element 250 is in the same radial layer as the control element support section 236 of the blank 200. The control element support section 236 extends around the whole circumference of the smoking article or rod articles. The control element support section 236 is a tube, e.g. a cylindrical tube. The control element support section 236 can be considered as having one or two layers extending around the rod articles. Any of these features is applicable to any embodiment.

In some aspects, the control element 250 defines a longitudinally extreme area of the section on which it is formed. In some aspects, the control element 250 is a longitudinally extreme (forward) part of the blank 200 which is part of the second part of the smoking article. The control element extends longitudinally beyond a remainder of the control element support section 236. The support section to which the control element is attached extends circumferentially beyond the control element 250. In some examples, the support section extends circumferentially beyond the control element on one longitudinal side only of the control element.

The control element 250 is movable circumferentially within a limited range. The control element 250 is movable between a first engaging surface 233*a* and a second engaging surface 233*b*. The first engaging surface 233*a* and second engaging surface 233*b* define a circumferentially extending channel 239 in which the control element 250 is movable. A part of the channel 239 is configured to allow ventilating air to pass therethrough. Thus, part of the circumferential extent of the channel 239 can be considered as a ventilation aperture.

The channel 239 is open along a longitudinal edge. In particular, the longitudinal edge of the channel 239 facing the control element 250 is open. This longitudinal edge extends substantially circumferentially. The channel 239 defines a longitudinal extreme or boundary of the section defining the channel 239. The first engaging surface 233*a* and the second engaging surface 233*b* are defined by a section of the blank 200 which is part of the other of the first or second part of the blank from the control element. The first engaging surface 233*a* and the second engaging surface 233*b* extend substantially longitudinally.

A single blank comprises the tab and a section defining the first and second engaging surfaces. In particular, a same layer of the same blank comprises the tab and a section defining the first and second engaging surfaces. The blank is arranged to frangibly separate or be cut to allow movement of the tab between the first and second engaging surfaces.

The control element 250 defines first and second limiting surfaces 253*a*, 253*b* at the edges of the control element in the axis of movement, i.e. at the circumferential edge of the control element 250. Contact of the first and second limiting surfaces 253*a*, 253*b* of the control element 250 between the first engaging surface 233*a* and the second engaging surface 233*b* limits relative rotation between the first and second parts. The rotation of the first part to the second part determines ventilation of the smoking article. In some aspects, the allowed range of rotation corresponds to a variation between a minimum and maximum ventilation level.

The first and second limiting surfaces 253*a*, 253*b* of the control element 250 extend substantially longitudinally. In some examples, the first and second limiting surfaces 253*a*, 253*b* of the control element 250 extend longitudinally beyond the section to which the control element attached. The first and second limiting surfaces 253*a*, 253*b* of the control element 250 are circumferentially positioned within the circumferential extent of the remainder of the section defining the control element. For example, the remainder of the section (control element support section 236) defining the control element extends around the whole circumference of the rod articles. The control element extends over only a part of the circumference. The control element 250 extends over only a relatively small proportion of the circumference of the smoking article. For example, the control element 250 extends over less than half the circumference. The control element 250 and the spacing of the first and second engaging surfaces 233*a*, 233*b* can be dimensioned to limit rotational movement to between 90 and 180 degrees, and in particular, to between 110 and 140 degrees, and more particularly, to approximately 120 degrees.

The first limiting surface 253*a* of the control element 250 and the first engaging surface 233*a* extend parallel to each other, and/or are complementary in shape. In some aspects, the second limiting surface 253*b* of the control element 250 and the second engaging surface 233*b* extend parallel to each other, and/or are complementary in shape. For example, the first and second limiting surfaces and the first and second engaging surfaces extend substantially longitudinally.

The control element 250 has a further function in controlling the ventilation of the smoking article. In particular, the control element 250 directly controls the ventilation of the smoking article by selectively covering or closing one or more ventilation areas. The control element 250 is configured to be movable into alignment with one or more ventilation areas in a radially adjacent part of the smoking article. The control element 250 is formed of a material which is substantially impermeable to air, in particular, paper which is not permeable to air. The control element 250 is configured to cover the one or more ventilation areas of the smoking areas, such that ventilation air cannot enter the smoking article through an area which is covered by the control element 250. The control element is impermeable to air between the first and second limiting surfaces 253*a*, 253*b*. The first and second limiting surfaces 253*a*, 253*b* define both the limits of rotation and define the amount of ventilation area which is covered or uncovered. The area of ventilation area covered by the control element 250 is variable and determines the ventilation.

Thus, the control element 250 has the dual function of both directly controlling a level of ventilation by covering one or more ventilation apertures and limiting movement of the control element to a pre-determined range, e.g. between maximum and minimum levels of ventilation.

The wrapped second blank 200 provides a connection between the second filter section 114 and the first filter section 112. This connection connects the second indexing surface (e.g. pawl 304) with the second filter section 114. The second indexing surface 304, second filter section 114, and second part of the smoking article, are movable circumferentially, and restrained longitudinally. In some examples, the longitudinal restraint is to a single longitudinal position, relative to the first part of the smoking article. In particular, the outer layer of the second blank 200 provides this connection. The outer layer of sheet material providing this connection surrounds, but does not itself provide, an indexing mechanism and/or rotation limitation mechanism.

The connection by the second blank 200 of the second filter section 114 to the first part of the smoking article comprises the fifth section 234, second section 214 and control element support section 236. The fifth section 234 is attached to the second filter section 114. The control element support section 236 is attached to the pawl support section 320 and/or is located forwardly of the fourth section 235. The blank 200 connects the second filter section 114 to control element support section 236. In particular, the outer layer of the blank 200 (i.e. second section 214) provides the connection, e.g. between the fifth section 234 and control element support section 236. The blank 200 provides an integral tube of material connecting the second filter section 114 to a contacting surface arranged to limit longitudinal movement, e.g. rearward movement of the second filter section 114 away from the first filter section. The contacting surface can substantially prevent longitudinal movement between the first and second parts of the smoking article in a single direction.

The connecting tube comprises two radial layers (i.e. two layers around the whole circumference) at a forward and rearward end, connected by a single layer. The connecting tube is integrally formed, e.g. from a single sheet of material. The fifth section 234, second section and control element support section 236 are integrally formed. Thus, a secure connection of the second filter section is provided.

The rearward area of the outer layer of the second blank 200 (second section 214) extends over, and is not affixed to, the rearward spacing section 310*b* of the first blank 300. As is also applicable to other embodiments, the outermost layer 240 of the blanks wrapped around the rod articles provides the only connection between the first and second filter sections. The attachment of the outermost layer to the first filter section is through a section (e.g. the pawl support section 320) which is restrained by an adjacent, separable, part (fourth section 235) of the blank in a longitudinal direction. These features can also be present, optionally in a modified form, in other embodiments of the invention.

In the example of FIG. 3, the blank 200 comprises one or more ventilation areas 270. In particular, a ventilation area 270 is formed in a part of the blank 200 for forming a different layer to the control element 250. In some aspects, the first (outer) layer 240 comprises the ventilation area 270 and the second (inner) layer 230 comprises the control element 250.

The control element 250 and ventilation area 270 are on adjacent layers. The channel 239 and ventilation aperture 270 are defined on separate (adjacent) layers of the smoking article, and are fixed relatively to each other. The control element 250 is movable relative to both the layer defining the channel and to the layer defining one or more ventilation area 270. The control element 250 is movable within the channel, and the control element 250 and so the control element is not merely any part of the layer defining the channel. The amount of area of the ventilation area 270 which is covered/uncovered directly by the control element is the only factor in determining the variation of ventilation area of the smoking article. In particular, further parts of the smoking article, e.g. the section defining the channel in which the control element is movable, are not configured to cover a ventilation area in the present invention to control a level of ventilation. The ventilation area 270 and first and second engaging surfaces 233*a*,233*b* are defined by a plurality of integral layers of sheet material, e.g. two layers of the same sheet of material.

The ventilation area 270 is elongate, extending in a direction in which the control element 250 is movable, i.e. circumferentially. The ventilation area 270 has a length which is shorter than a length of the channel 239. In some examples, the length of the ventilation area 270 is substantially the same as the length (i.e. in a circumferential direction) of travel of the control element 250 within the channel 239. This allows the control element 250 to be movable only between an extreme position in which the ventilation area 270 is fully covered (minimum ventilation, control element 250 contacting the first engaging surface 233*a*) and a further extreme position in which the ventilation area 270 is fully open (maximum ventilation, control element 250 contacting the second engaging surface 233*b*). The approximate equivalence of length of travel of the control element 250 and ventilation area 270 means that any movement of the control element 250 within the channel 239 (i.e. of the first part of the smoking article relative to the second part of the smoking article) changes the ventilation of the smoking article. A variation of the position of the control element directly varies ventilation across at least a majority of the distance between the first and second engaging surfaces. In some examples, a variation of the position of the control element directly varies ventilation across substantially a whole distance between the first and second engaging surfaces. Thus, the ventilation varies with the position of the control element.

The ventilation area 270 is shown as a single ventilation area. Alternatively, the ventilation area 270 comprises a plurality of apertures, in particular, a plurality of apertures in a direction of movement of the control element 250. The ventilation area 270 comprises a plurality of separate apertures in a circumferential direction. In some aspects, the ventilation area 270 further comprises a plurality of apertures in a longitudinal direction. The ventilation area 270 comprises a grid or array of apertures. For example, the apertures are formed by electroperforation (EP).

For a single aperture, the control element 250 covering a part of the aperture substantially limits ventilating air to the uncovered area. However, in some circumstances some ventilating air can travel circumferentially within the ventilation aperture, increasing the ventilation. The plurality of apertures isolates air flow through the ventilation area to flow in each ventilation aperture separately. Therefore, covering of one or more apertures can more effectively limit air flow to only the uncovered area.

In some aspects, the control element 250 is arranged to selectively cover at least one ventilation area. In some examples, the ventilation area comprises a plurality of apertures in a direction of movement of the control element 250. The ventilation area can be formed as part of the same blank, a separate (e.g. inner) blank wrapped around a rod article (e.g. on blank 300) or on an a separate outer wrap surrounding the control element. In particular, the control element 250 is movable to cover a plurality of radially spaced and at least partially aligned ventilation apertures. At least one of the radially spaced ventilation apertures comprises comprising a plurality of apertures in a direction of movement of the control element 250.

The second blank 200 does not directly define the first or second indexing surface. The first indexing surface is defined on the first filter section, for example as described above. The second indexing surface is defined on an annular layer extending around the first indexing section, for example as described above. The blank 200 is configured to connect with the second indexing section. In particular, the control element support section 236 is configured to connect with an exterior of the unit defining the second indexing section. For example, the control element support section 236 is attached with adhesive to an exterior of the second indexing section unit. The section defining the control element is also attached to a part of the inner wrap 300 defining the second indexing surface 304. In one aspect, the control element 250 is also defined by the control element support section 236, such that the section of the blank defining the control element 250 is directly affixed to the support section 320. The control element 250 is connected to the indexing mechanism such that movement of the control element between the engaging surfaces 233*a*, 233*b* is in a plurality of discrete steps, corresponding to discrete ventilation levels.

The fourth section 235 is attached to a rod article of the first part, e.g. the first filter section 112. The first part of the smoking article comprises the fourth section 235. The fourth section 235 is separable, or separate, from the adjacent sections 234,236 on the inner layer of the second blank 200. For example, the second blank 200 comprises a frangible connection of the fourth section 235 to the remainder of the blank 200, e.g. perforations 225 around the fourth section. In some examples, the fourth section 235 also has a frangible connection to the corresponding section on the outer layer, i.e. section 214*c*. The frangible connections are configured to be broken on first rotation between the first and second sections.

In any embodiment, the smoking article is configured to limit or prevent longitudinal movement between the rotationally movable parts of the smoking article, e.g. the control element and engaging surfaces. The wrapped blank is arranged to define contacting surfaces which limit or prevent longitudinal movement. In some aspects, the contacting surfaces limit movement in a direction in which the first and second filter sections are urged apart. The direction can alternatively be defined as the first and second parts of the smoking article are moved apart, or a rearward part urged rearwardly. In some examples, different contacting surfaces limit or prevent longitudinal movement in the opposite direction.

In some aspects, the contacting surfaces extend substantially circumferentially. In some examples, the contacting surfaces extend around the whole circumference of the smoking article. This large extent of the contacting surfaces ensures that longitudinal separation of the movable parts of the smoking article is difficult or does not occur.

One of the contacting surfaces configured to limit or prevent longitudinal movement can be defined by the control element support section, in any embodiment. For example, the contacting surface can be on an opposite longitudinal side of the control element support section to the control element. In some aspects, the contacting surface is an annular or raised edge, for example, provided by a wrapped tubular sheet material. The contacting surface extends radially and circumferentially. Thus, the arrangement of the control element support section and control element (e.g. which are integral and in the same radial layer), provides for limiting both longitudinal and rotational movement, and directly determining ventilation.

In some aspects, the fourth section 235 is located between two sections of the second part, and the aligned section 214*c* on the outer layer is also part of the second part. The sections of the second part surrounding the fourth section substantially prevent the second part from moving longitudinally relative to the first part. The sections of the second part 234,214,236 extend over and into the same radial layer as the tubular raised edge of the fourth section 235. In particular, contact between the control element support section 236 and fourth section 235 prevents the second part from moving longitudinally rearwardly relative to the first part. Contact between the fifth section 234 and fourth section 235 prevents the second part from moving longitudinally forwardly relative to the first part. The contact of the fourth section 234 with the adjacent sections 235,236 is with circumferentially extending edges, such that relative circumferential movement is possible.

In a further aspect, the pawl support section 320 provides one or more contacting surfaces configured to prevent or limit longitudinal movement between the first and second parts of the smoking article. The circumferentially extending edges of the pawl support section 320 and first and/or second spacing sections 310*a*,310*b* can engage to prevent longitudinal movement.

The sections of the second blank 200 defining the first part of the smoking article are frangibly attached to sections of the blank 200 defining the second part of the smoking article. In particular, the control element support section 236 is frangibly attached to the third section 233 by a frangible connection 226 on the inner layer. A part of the frangible connection 226*a* initially connects the control element 250 to the adjacent section, i.e. third section 233. The second section 214*a* is frangibly attached to the first section 213 by a frangible connection 228 extending onto the outer layer 240 of the blank 200, and connecting with the connection 226. The frangible connections 226,228 are substantially aligned with each other. Both frangible connections 226,228 extend substantially circumferentially at the same longitudinal position. For example, any of the frangible connections on the blank can comprise a plurality of perforations extending between the sections which are operable to move relative to each other in use.

The shaded areas shown are arranged to connect with a radially adjacent surface, on a radially inner side of the shaded area. The adjacent surface can be an inner layer of sheet material, for example, the section 214*a* is connected to section 236. The adjacent section can be a rod article, for example fifth section 234 is connected to second filter section (or a spacer wrapped only around the second filter section). In some aspects, the rod articles are wrapped with one or more layers of sheet material (not shown) within the second blank 200, e.g. the first blank 300, and to which the blank 200 is attached. The connection can be by an adhesive. In particular, the second blank 200 is coated with an adhesive prior to wrapping around the rod articles.

In some examples, the first blank 300 wraps around only the first filter section 112. An exterior of the wrapped first blank 300 is a cylinder of substantially uniform diameter over the longitudinal extent of the wrapped first blank 300. The uniform diameter (e.g. of a spacing section) provides a substantially smooth surface over which the control element 250 of the second blank 200 is movable. For example, one of the spacing sections provides a smooth, e.g. cylindrical, exterior surface over which the control element 250 can rotate. The control element 250 is movable underneath the outer layer of the blank 200. The exterior of the wrapped blank 200 can have substantially the same diameter as the further rod articles 110 on which the blank 200 is wrapped. In particular, the second filter section 114 and/or tobacco rod 111 can be dimensioned, or can be overwrapped with one or more layers of sheet material, to have the same external diameter as the wrapped first filter section 112. The substantially equal diameters of the rod articles allow wrapping and attachment of the blank 200.

In a further embodiment (not shown), the first blank 300 comprises only the first and second spacing sections 310*a*, 310*b*. The first and second spacing sections 310*a*,310*b* are not connected by a support section, and are separate sections of sheet material, wrapped around the rod article 11*n* in the same location as described in FIG. 2. The first and second spacing sections 310*a*,310*b* can be configured to wrap once around the rod articles to form a single spacing layer, or configured to wrap two times around the rod articles to form two spacing layers. The inner layer and outer layer are wrapped sequentially. In particular, the area of the blank for forming the inner layer is wrapped around the whole circumference of the smoking article, i.e. around the rod articles. The outer layer is integrally formed as part of the same blank, and follows the inner layer. The outer layer is wrapped around the whole circumference. In some aspects, a further extent of blank overlaps with the outer layer, to secure the outer layer as a tube. In some aspects, an overlap also secures the inner layer as a tube. The wrapping of the blank is continuous.

The pawl support unit 306 comprising the pawl 304 is attached to the second blank 200. In particular, the pawl support unit 306 is attached to a section of the second blank 200 defining the control element (as described below). The pawl 304 has the same function as described above of extending between the spacing sections 310 to engage with the first indexing surface.

The plurality of layers around the rod articles can be considered as divided into sections. The sections generally form a part of either the first part or the second part of the smoking article. In some aspects, one or more sections are not attached to either the first or second part, where the rotational position of such a section does not relate to the determination of the property of the smoking article.

In some examples, in order to control the property of the smoking article, the smoking article can have at least one of the following characteristics. The first part and second part each extend over an external surface of the smoking article. This allows a user to grip both the first and second parts, and generate relative movement between the first and second parts, e.g. a relative rotation. The first and second indexing surfaces are configured to engage to provide indexing movement. This feature is optional, and the property of the smoking article can be controlled without requiring indexing.

The fourth section 235 as described is optional. In particular, the function of preventing longitudinal movement provided by the fourth section 235 can instead, or only, be provided by the support section 320 movable only circumferentially between the spacing sections 310*a*,310*b*. The blank 200 comprises a plurality of layers defining a first part of the smoking article in a forward area, and a second part of the smoking article in a rearward area.

Figure 4:
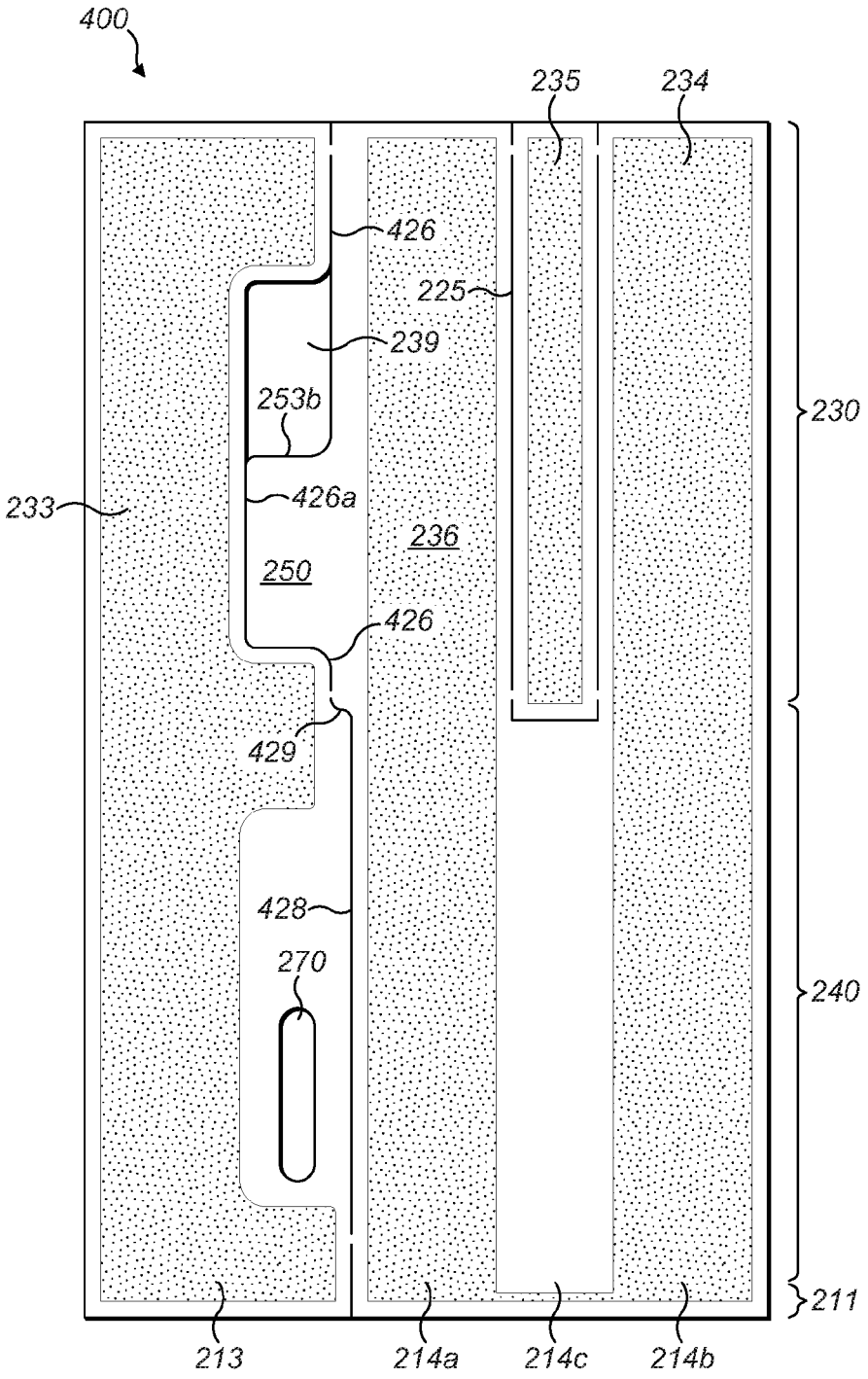
FIG. 4 is a plan view of a blank according to a second embodiment of the smoking article.

FIG. 4 shows a second example of a blank 400. The blank 400 is substantially the same as the blank 200, and equivalent parts have been labelled the same. The blank 400 is also configured to be wrapped around the blank 300, and around one or more rod articles 110 of a smoking article.

The blank 400 differs from the blank 200 in the location of the frangible connection between the first and second parts. In particular, in the blank 400 the frangible connection between the first and second parts on the inner layer of the blank (when wrapped) is not aligned with the frangible connection between the first and second parts on the outer layer of the blank (when wrapped). The interface between first and second parts of the smoking article is spaced apart in the plurality of layers.

In particular, the control element support section 236 is frangibly attached to the third section 233 by a frangible connection 426 on the inner layer. A part of the frangible connection 426*a* initially connects the control element 250 to the adjacent section, i.e. third section 233. In the example shown, the frangible connection 426 extends on both circumferential sides of the control element 250. Alternatively, the control element 250 is at a circumferential end of the inner layer 230 initially, such that the frangible connection 426 extends in only a single connection from the control element 250.

The second section 214 is frangibly attached to the first section 213 by a frangible connection 428 extending onto the outer layer 240 of the blank 200, and connecting with the connection 426. For example, the frangible connections comprise a plurality of perforations extending circumferentially between the sections such that the blank is configured to preferentially tear along the perforations, and allow the sections to move relatively to each other in use.

The frangible connections of the inner and outer layers 426,428 are offset from each other in a longitudinal direction. In particular, the frangible connections 426, 428 are not substantially aligned with each other. Both frangible connections 426,428 extend substantially circumferentially at different longitudinal positions. The frangible connection 426*a* extends circumferentially at a further different longitudinal position. The frangible connections 426,428 are connected by a longitudinal extending frangible connection 429. Thus, a forward and rearward part of the blank 400, on both inner and outer layers, are movable relative to each other when the frangible connections 426,426*a*,428,429 are broken on application of a force to change ventilation for the first time. The interface between the forward and rearward part of the blank 400 is longitudinally spaced apart on the inner and outer tubular layers provided by wrapping the blank 400.

The different locations of the frangible connections 426, 428 (or interface between first and second parts of the smoking article) means that air cannot be drawn into the smoking article directly radially through aligned gaps between the sections of the blank 400 at the frangible connections. Instead, air entering through such gaps must also be drawn longitudinally. Thus, the amount of air drawn into the smoking through such gaps is reduced, improving control of the level of ventilation using the defined ventilation apertures.

Figure 5:
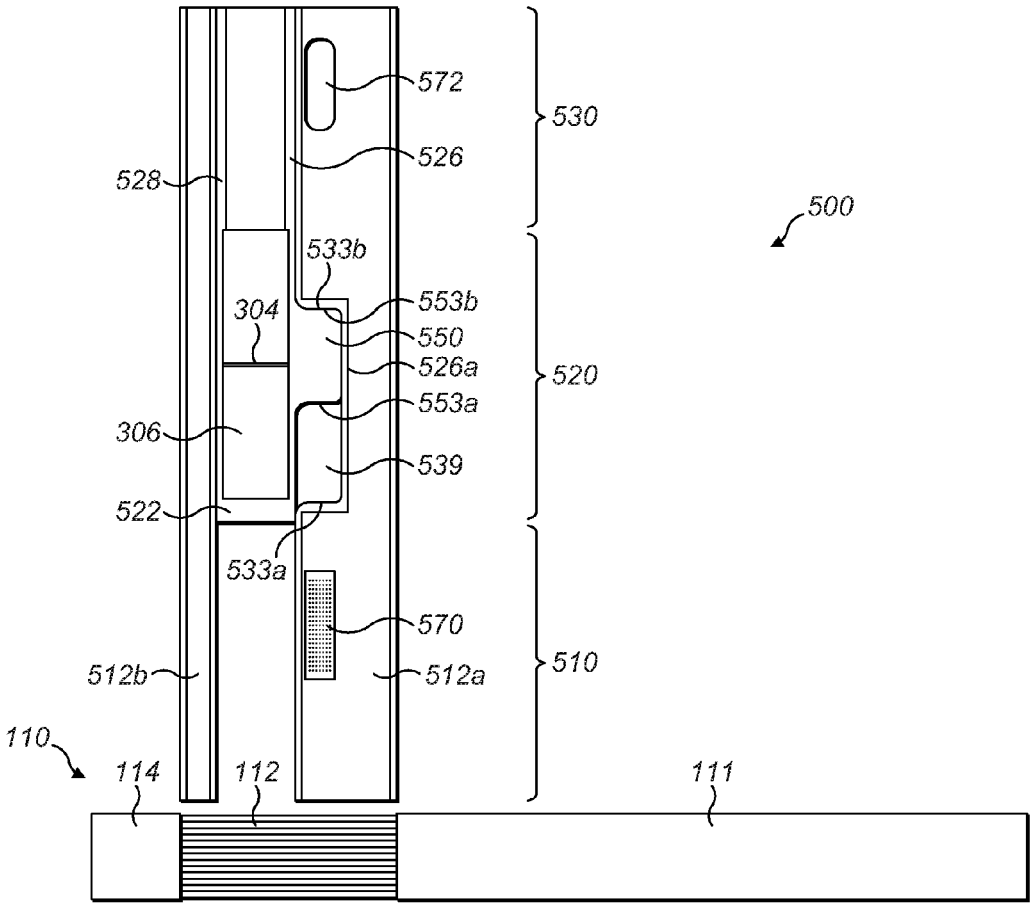
FIG. 5 is a plan view of a blank according to a third embodiment of the smoking article.

FIG. 5 shows a third embodiment of a blank 500. A smoking article comprising the blank 500 has substantially the same functions as described above. Features have the same arrangement and function unless otherwise described.

Figure 6:
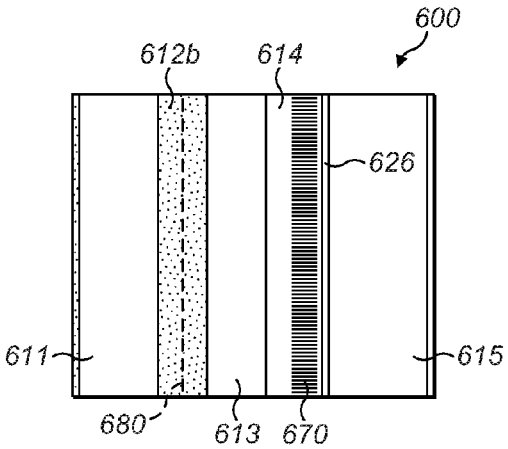
FIG. 6 is a plan view of a further blank according to the third embodiment of the smoking article.

The blank 500 is configured to wrap directly around one or more rod articles of a smoking article, in particular, around only the first filter section 112. As described above, the first filter section 112 defines a first indexing surface. The blank 500 is configured to define three complete layers extending around the circumference of the first filter section, and comprises areas to define an inner layer: first layer 510; an intermediate layer: second layer 520; and an outer layer: third layer 530. The first, second and third layers 510,520, 530 are integrally formed on a single piece of sheet material, arranged to be wrapped three times around the circumference of a rod article. In some examples, the blank 500 is overwrapped with a further separate layer, from a further blank 600, which is shown in FIG. 6. The blank 500 is an alternate to both the first and second blanks 300,200 described with respect to FIGS. 2 and 3.

The first layer 510 comprises first and second spacing sections 512*a*, 512*b*. The first and second spacing sections 512*a*, 512*b* are configured to directly attach to and circumscribe a rod article, in particular, the first filter section 112 defining the first indexing surface. The first and second spacing sections 512*a*, 512*b* have the function of spacing the first and second indexing surfaces at the correct radial distance to allow indexing. The first and second spacing sections 512*a*, 512*b* are longitudinally spaced apart. The configuration of the first and second spacing sections 512*a*, 512*b* is substantially the same as the second (inner) portions 311*b* of the blank 300. A control element 550 is configured to directly overlie one of the spacing sections 512*a*, 512*b*. The control element is movable over the spacing section 512*a*, the spacing section providing a substantially smooth exterior surface over which the control element is easily moved. The control element is spaced by the spacing section from the first filter section. The first filter section defines the first indexing surface, and so does not provide a smooth surface for the control element.

One of the first and second spacing sections 512*a*, 512*b*, shown as the first spacing section 512*a*, comprises a first ventilation area 570 in an inner layer 510. The first ventilation area 570 comprises a plurality of apertures, in particular, a plurality of apertures in a direction of movement of the movable control element 550, i.e. a plurality of separate apertures in a circumferential direction. In some aspects, the first ventilation area 570 further comprises a plurality of apertures in a longitudinal direction. The first ventilation area 570 comprises a grid or array of apertures. For example, the apertures are formed by electroperforation (EP).

The second layer 520 of the blank 500 comprises the control element 550, having the same function as the control element 250 described above. In particular, the control element 550 defines a longitudinally extreme part of the section on which it is formed. A section attached to the control element 550 extends around the whole circumference of the rod articles. The control element 550 is movable circumferentially within a limited range. The control element 550 is movable between a first engaging surface 533*a* and a second engaging surface 533*b*. The first engaging surface 533*a* and second engaging surface 533*b* define a circumferentially extending channel 539 in which the control element 550 is movable, as described above.

The control element 550 defines first and second limiting surfaces 553*a*, 553*b* at the edges of the control element in the axis of movement, i.e. at the circumferential edge of the control element 550. Contact of the first and second limiting surfaces 553*a*, 553*b* of the control element 250 between the first engaging surface 533*a* and the second engaging surface 533*b* (as shown) limits relative rotation between the first and second parts of the smoking article.

The control element 550 has a further function in controlling the ventilation of the smoking article. In particular, the control element 550 directly controls the ventilation of the smoking article by selectively covering one or more ventilation areas. The control element 550 is configured to be movable over one or more ventilation areas in a radially adjacent, and integrally formed, part of the smoking article. The control element 550 is formed of a material which is substantially impermeable to air, in particular, paper which is not permeable to air. The control element 550 is configured to cover the one or more ventilation areas of the smoking areas, such that ventilation air cannot enter the smoking article through an area which is covered by the control element 550. The control element is impermeable to air between the first and second limiting surfaces 553*a*, 553*b*. The first and second limiting surfaces 553*a*, 553*b* define both the limits of rotation and define the amount of ventilation area which is covered or uncovered.

Thus, the control element 550 has the dual function of both directly controlling a level of ventilation by covering a part of a ventilation area and limiting relative movement of the first and second parts of the smoking article between maximum and minimum levels of ventilation.

The control element 550 is formed on a support section 522 of the blank 500. The control element extends longitudinally beyond a remainder of the control element support section 522 defining the second layer 520. The control element 550 defines the longitudinally extreme area of the section to which the control element is attached. Thus, the first and second limiting surfaces 553*a*, 553*b* of the control element 550 extend longitudinally beyond the section to which the control element attached. The control element support section 522 is a tube. The control element is curved as a part of that tube.

The support section 522 further functions as a support for the second indexing surface. In particular, the second indexing surface comprises a pawl 304 formed on a pawl support unit 306, which is attached to the support section 522. The pawl 304 is configured to extend between the first and second spacing sections 512*a*, 512*b*, and engage with the first indexing surface. The pawl and pawl support unit are substantially as described with respect to the blank 200. Thus, the second layer 520 of the blank comprises both the control element 550 which directly controls ventilation and limits movement between a maximum and a minimum ventilation, and also supports or comprises the second indexing surface.

The control element 550 and ventilation area 570 are on different layers, e.g. on initially connected areas. The channel 539 and ventilation aperture 570 are defined on separate layers of the smoking article, and are fixed relatively to each other. The control element 550 is movable relative to both the layer defining the channel and to the layer defining one or more ventilation area 570. The control element 550 is movable within the channel, and the control element 550 covering ventilation area 570 is not merely any part of the layer defining the channel. The amount of area of the ventilation area which is covered/uncovered directly by the control element is the only factor in determining the variation of ventilation area of the smoking article. In particular, further parts of the smoking article, e.g. the section defining the channel in which the control element is movable, are not configured to cover a ventilation area in the present invention to control a level of ventilation.

The third layer 530 of the blank 500 comprises a second ventilation area 572. The second ventilation area 572 is on one of the spacing sections 512*a*, 512*b*, in particular, the same (first) spacing section as the first ventilation area 570. The second ventilation area 572 is a single ventilation area or aperture. The single ventilation area allows the control element 550 to be clearly seen through the second ventilation area 572, providing an indication to a user of the position of the control element 550, and hence the level of ventilation. Alternatively, the second ventilation area 572 can comprise a plurality of ventilation apertures. The control element 550 can still be visible through a plurality of apertures. At least one of the first and second ventilation apertures 570,572 comprises a plurality of apertures to effectively control ventilation in response to a position of the control element 550, as described above.

The movable control element 550 is located radially between the first and second ventilation apertures 570,572. The first and second ventilation apertures 570,572 are at least partially aligned with each. In particular, the first and second ventilation apertures 570,572 have substantially the same extent in a direction of movement of the control element 550, i.e. circumferential extent. The first and second ventilation apertures 570,572 are substantially aligned with each other. Thus, the control element 550 is configured to simultaneously cover the first and second ventilation apertures 570,572 to control ventilation. Ventilating air passes radially directly through both the first and second ventilation apertures 570,572, and through the channel 539, over the area not covered by the impermeable control element 550.

The third layer 530 of the blank 500 comprises the first and second spacing sections 512*a*, 512*b* and the support section 522. Thus, the third layer 530 has substantially the same arrangement as the second layer. The third layer 530 is arranged to overlie the control element 530. In particular, the first or second spacing section 512*a*, 512*b* defining the second ventilation aperture 572 overlies the control element 550.

The blank 500 comprises only the first and second spacing sections 512*a*, 512*b* (extending over the first, second and third layers), and the support section 522 (extending over the second and third layers). The first and second spacing sections 512*a*, 512*b* and support section 522 are configured to be movable to each other, to control ventilation. In particular, the support section 522 is rotatable between the longitudinally spaced first and second spacing sections 512*a*, 512*b*. As such, the support section 522 is limited from longitudinal movement by engagement with the first and second spacing sections 512*a*, 512*b*. The support section 522 and first and/or second spacing sections 512*a*, 512*b* can be considered as having contacting surfaces configured to limit or prevent longitudinal movement when wrapped. The contacting surfaces can function substantially as described above.

The first and second spacing sections 512 and support section 522 are initially connected by a first and second frangible connection 526,528 extending over the second and third layers. The frangible connections 526, 528 are substantially as described above, e.g. circumferentially extending line of perforations. The connection 526 comprises a part 526*a* where the control element 550 is frangibly attached to a spacing section 512*a*.

A smoking article comprising first, second and third layers from the blank 500 can also comprise a further blank 600, as shown in detail in FIG. 6. The blank 600 is configured to overwrap the layers formed by the blank 500 already wrapped on the rod articles 110.

FIG. 6 shows the blank 600 comprises a sheet material dimensioned to form a single layer, being the outer layer of the smoking article. The blank 600 is dimensioned to extend longitudinally around the first filter section 112, second filter section 114 and optionally also the tobacco rod 111. In some examples, the blank 600 connects the first filter section 112 and tobacco rod. The blank 600 connects the second filter section 114 to the first filter section, whilst allowing relative movement between the filter sections 112, 114. The blank 600 is configured to allow the selection of ventilation as described above, and does not affect the selection of the ventilation. In some examples, the blank provides a base level of ventilation into the smoking article.

The blank 600 is configured to form a tube, extending around the whole circumference of the smoking articles. The blank 600 comprises a ventilation area 670 extending at least over the area of the first and second ventilation area 570,572 of the blank 500. The ventilation area 670 can extend over at least the length of the channel 539 in which the control element 550 is movable. In particular the ventilation area 670 extends around the whole circumference of the blank 600. Thus, the change of ventilation of the smoking article is independent of the ventilation area 670. In some examples, the section of the blank 600 defining the ventilation area 670 is movable with the control element 550, and so is movable around the first and second ventilation apertures. The ventilation area 670 is at least long enough to extend over the whole circumferential length of the first and second ventilation apertures 570,572 over the whole length of movement of the control element 550.

The blank 600 comprises a first section 611 arranged to connect to the second filter section 114. The first section 611 can have adhesive applied, to provide the attachment to the second filter section 114.

The blank 600 comprises a second section 612 overlying the second spacing section 512*b*. The second section 612 is not attached to the second spacing section 512*b*, and has no adhesive applied around the whole circumference in the area overlying the second spacing section 512*b*. Thus, the wrapped blank 600 is movable over the second spacing section 512*b*.

The blank 600 comprises a plurality of ventilation apertures 680 providing a base level of ventilation, e.g. in the second section 612. The ventilation area provided by the ventilation apertures 680 is substantially independent of the level of ventilation selected by rotation of the first and second parts of the smoking article. The ventilation apertures 680 extend around the whole circumference of the blank 600. The second spacing section 512*b* underlying the ventilation apertures 680 has further ventilation apertures (shown as dashed line) or is formed of a porous material to allow base ventilating air into the smoking article.

The blank 600 comprises a third section 613 overlying the support section 522 of the blank 500. The third section 613 is configured to attach to the support section 522, such that the third section 613 (and integral parts of the blank 600) rotate with the second indexing surface and control element 550. For example, adhesive is applied to the third section 613 prior to wrapping of the blank 600 around the blank 500 and rod articles 110. Thus, the second filter section 114 is securely and movably attached to the first part of the smoking article.

The third section 613 is attached to the support section 522, which is prevented from longitudinal movement (i.e. perpendicular to the indexing direction) by the first and second spacing sections 512*a*, 512*b*. Thus, the blank 600 is also prevented from longitudinal movement when wrapped.

The first, second and third sections 611,612,613 of the blank 600 are integrally formed, for example, as described for the second section 214 of the blank 200. The blank 600 provides a connection between a mouth end rod article, e.g. the second filter section, and the second indexing surface. The blank 600 couples the second filter section to the first filter section, and allows relative movement. The blank 600 provides an exterior surface of the smoking article which can be manipulated by a user to select ventilation. For example, the first, second and third sections 611,612,613 of the blank 600 provide a larger area than the support section 522 which can be gripped and turned relative to the first part of the smoking article, to control ventilation. In some aspects, the blank 600 provides a connection between the second filter section and a contacting surface configured to prevent longitudinal movement.

The blank 600 further comprises a fourth section 614 overlying the first support section 512*a*. The fourth section 614 is movable around the first spacing section 512*a*, and is not attached to the fourth section 614. The fourth section 614 defines the ventilation area 670.

The fourth section 614 provides a further area of the second part which can be gripped by a user. The fourth section 614 allows ventilation therethrough (through the ventilation area 670), and is also movable relative to the first and second ventilation areas 570,572. A cross-section through the wrapped blanks 500,600 at the location of the fourth section 614 indicates four layers which alternate in attachment to the first and second parts of the smoking article. Thus, all four layers are movable relative to an adjacent layer. In order from adjacent the rod article 110, the wrapped layers are: first support section 512*a* (first part), control element 550 (second part), first support section 512*a* (first part) and fourth section 614 (second part).

The blank 600 further comprises a frangible connection 626 configured to allow separation of the fourth section 614 of the blank 600 from a further fifth section 615. The frangible connection 626 can be formed by perforations in the material of the blank 600, extending circumferentially.

The fifth section 615 overlies the first support section 512*a*. The fifth section 615 is configured to attach to the first support section 512*a*. For example, adhesive is applied to the fifth section 615 prior to wrapping of the blank 600 around the blank 500 and rod articles 110. Thus, once the frangible connection 626 is broken, the fifth section 615 is movable with the first part of the smoking article, i.e. is affixed to the first indexing surface and/or first filter section.

The integral first, second, third and fourth sections 611, 612,613, 614 define a tube which is maintained in a radial position by contact with one of the spacing sections (e.g.

rearward spacing section 512*b*). The tube is attached to, and supports, the second indexing surface 304. Therefore, the radial position of second indexing surface 304 is maintained.

The second part of the smoking articles comprises the first, second, third and fourth sections 611,612,613, 614 of the blank 600.

Alternatively, the frangible connection can be between the third and fourth sections 613,614, and the fourth section 614 is a part of the first part of the smoking article.

The embodiment described is an example only of a smoking article having an inner layer and an outer layer around one or more rod articles. The inner and/or outer layers may be configured differently, with less or more separation lines or adhesive areas. The outer wrap is at least partially arranged around the inner wrap, such that at least part of the inner wrap is radially within the outer wrap. The inner and outer wraps are generally tubular, and in particular, cylindrical.

During manufacture, the blanks 200,300 or blanks 200, 400 are each wrapped twice around rod articles for forming one smoking article. Alternatively, the blank 500 is wrapped three times, followed by a single wrap of the blank 600.

Alternatively, a blank comprising two (or more) of the features of blank 200,300,400,500,600 are wrapped the appropriate number of times around rod articles for forming two (or more) smoking articles. The wrapping is carried out substantially as described above. The rod article can be cut into two (or more) separate sections, one for each smoking article.

Figure 7:
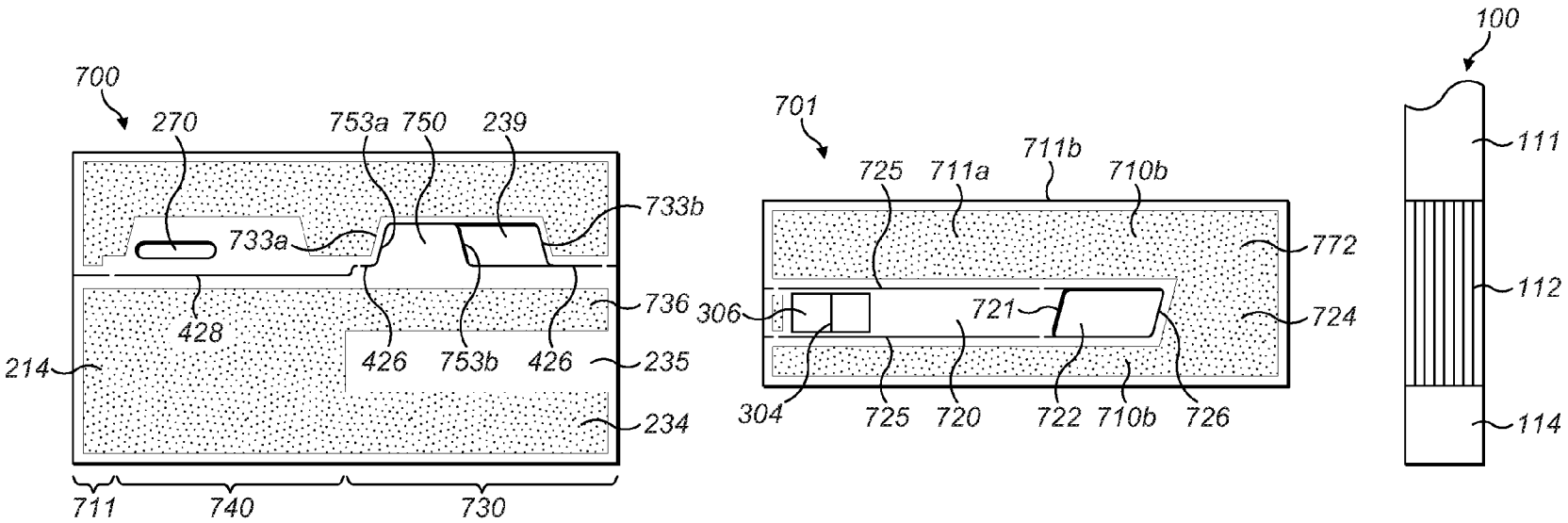
FIG. 7 is a plan view of blanks according to a fourth embodiment of the smoking article.

FIG. 7 shows a further embodiment of the first blank 701 and the second blank 700. The first and second blanks 701,700 are configured and function substantially as described with respect to FIGS. 1 to 4, with the following differences. Equivalent reference numerals indicate the same parts. The second blank 700 includes longitudinally offset frangible connections 426,428, as described with respect to FIG. 4. However, the features of the second blank 700 are also applicable to a blank as described in FIGS. 1 to 4 without longitudinally offset frangible connections 426,428. The blanks 700,701 are configured to be wrapped around one or more rod articles to provide tubes have one or more layers, and in particular, a plurality of layers.

The second blank 700 comprises material arranged to integrally extend over a an inner layer 730, an outer layer 740, and an overlap 711 to secure the second blank as a tube when wrapped around the rod articles.

The second blank 700 comprises a control element 750, configured to control ventilation and limit movement substantially as described above for the control element 250. The control element 750 defines first and second limiting surfaces 753*a*, 753*b* at the edges of the control element in the direction of movement, i.e. at the circumferential edge of the control element 750. The first and second limiting surfaces 753*a*, 753*b* extend at an angle to a longitudinal axis of the smoking article. The first and second limiting surfaces 753*a*, 753*b* extend at an angle to the axis of movement of the control element. The first and second limiting surfaces 753*a*, 753*b* can be considered as sloped. The first and second limiting surfaces 753*a*, 753*b* are substantially straight, i.e. extend at a constant angle. The angled edges continuously varies in circumferential position with variation in longitudinal position. The angled leading edge and/or trailing edge is angled to a longitudinal axis of the smoking article by an angle of between 10 and degrees, and optionally, between 15 and 35 degrees.

The first and second limiting surfaces 753*a*, 753*b* are angled in opposite senses to the longitudinal axis. The first and second limiting surfaces 753*a*, 753*b* are angled towards each other in a direction away from the support section 736. A circumferential extent of the control element 750 distal from the attached section is smaller than a circumferential extent of the control element 750 proximal to the attached section. Alternatively, the first and second limiting surfaces 753*a*, 753*b* can be curved. At least a part of the first and second limiting surfaces 753*a*, 753*b* is at an angle to the longitudinal axis of the smoking article when wrapped. Alternatively, the first and second limiting surfaces 753*a*, 753*b* are angled in the same sense to the longitudinal axis, e.g. are substantially parallel.

The first and second engaging surfaces 733*a*,733*b* also extend at an angle to the longitudinal axis of the smoking article, and/or at an angle to the direction of movement of the control element. The first and second engaging surfaces 733*a*,733*b* extend at the same angle and/or have a complementary shape to the first and second limiting surfaces 753*a*, 753*b*.

The first blank 701 comprises a support section 720. The support section 720 has substantially the same configuration and function as the support section 320 described with respect to FIG. 2. The support section 720 is attached to one or more (two as shown) spacing sections 710 with frangible connections 725, namely, first and second spacing sections 710. The support section 720 extends around at least one whole circumference of the rod articles 110.

The support section 720 comprises a support section leading edge 721. The support section leading edge 721 defines the initial point of the support section 720 which is first wrapped around the rod articles 110. The leading edge 721 can be considered as a circumferential leading edge, since the leading edge 721 is at a circumferential edge of the section. The support section leading edge 721 extends at an angle to a longitudinal axis of the smoking article. The support section leading edge 721 extends at an angle to the axis of movement of the control element. The support section leading edge 721 can be considered as sloped. The support section leading edge 721 is substantially straight, i.e. extends at a constant angle. Alternatively, the support section leading edge 721 can be curved.

The first blank 701 comprises first and second spacing sections 710*a*,710*b*, arranged with a similar configuration and function to the first and second spacing sections described above. In some aspects, the second spacing section 710*b* comprises ventilation apertures 772 arranged to allow ventilating air as controlled by the control element 750 through the second spacing section 710*b*.

The first blank 701 comprises a spacer connection 724 between the first and second spacing sections 710*a*,710*b*. The spacer connection 724 is at a leading edge of the first blank 701, i.e. the point on the blank 701 first wrapped around the rod articles 110. The spacer connection 724 connects the leading edges of the first and second spacing sections 710*a*,710*b*.

The spacer connection 724 is an integral connection between the first and second spacing sections 710*a*,710*b*. The spacer connection 724 is formed of the same sheet material as the first and second spacing sections 710*a*,710*b*, and remainder of the first blank 701. The spacer connection 724 extends in the longitudinal space between the first and second spacing sections 710*a*,710*b*. The spacer connection 724 connects second portions 711*b* forming an inner layer of the blank 701, and does not extend to the first portions 711*a* forming an outer layer of the blank 701. The spacer connection 724 extends across the space separating the first and second spacing sections 710*a*,710*b* in which the support section 720 (and pawl 340) is movable.

The spacer connection 724 and first and second sections 710*a*,710*b* provide a continuous area of the sheet material, which extends the whole length of the blank 701 in a direction of the longitudinal axis of the smoking article when wrapped. The spacer connection 724 is configured to be permanently and/or integrally attached to the spacing sections 710. In particular, there is no frangible connection between the spacer connection 724 and spacing sections 710*a*,710*b*.

The spacer connection 724 and longitudinally adjacent areas of the spacing sections 710 are initially affixed to the rod articles to begin wrapping of the first blank 701, for example, with adhesive. The spacer connection 724 provides for the blank 701 to have a single initial area of attachment to the rod articles 110.

The spacing sections 710*a*,710*b* are not affixed as independent elongate sections of sheet material, requiring separate attachment to the rod articles. Instead, a single area of the first blank 701 is attached to the rod articles, the single area extending across the whole longitudinal extent of the first blank 701. Thus, the connection of the leading edges of the spacing sections 710*a*,710*b* improves initial attachment of the first blank 701 to the rod articles.

The leading edge of the first blank 701, defined by the spacer connection 724 and first and second spacing sections 710*a*,710*b*, extends substantially parallel to a longitudinal axis of the smoking article. In particular, the leading edge of the first blank 701 is not angled as described for the support section leading edge 721. The spacer connection 724 and first and second spacing sections 710*a*,710*b* are affixed to the rod article(s), i.e. first filter section 112, at and adjacent to the leading edge. In some examples, the spacer connection 724 and first and second spacing sections 710*a*,710*b* are also affixed to the rod article(s) around the whole circumference of the rod article or full circumferential extent of the spacer connection 724.

The spacer connection 724 has a trailing edge 726 at a circumferentially opposite end of the spacer connection 724 to the leading edge. The spacer connection trailing edge 726 extends between the first and second spacing sections 710. The spacer connection trailing edge 726 extends at an angle to a longitudinal axis of the smoking article. The spacer connection trailing edge 726 extends at an angle to the axis of movement of the control element. The spacer connection trailing edge 726 can be considered as sloped. The spacer connection trailing edge 726 is substantially straight, i.e. extends at a constant angle. The spacer connection trailing edge 726 is parallel and/or complementary to the support section leading edge 721. Alternatively, the spacer connection trailing edge 726 can be curved, or has any feature of the angled limiting surfaces 753*a*,753*b* or support section leading edge 721 described above. Alternatively, the spacer connection trailing edge 726 can extend substantially longitudinally, i.e. is not angled.

The spacer connection trailing edge 726, support section leading edge 721 and first and second spacing sections 710 define an aperture 722 in the first blank 701. The aperture 722 provides a space into which the support section 720 is movable. The aperture 722 has a circumferential extent which is greater than a circumferential extent of movement of the control element 750. Thus, the spacer connection trailing edge 726 does not determine the range of movement of the control element 750. Alternatively, the aperture 722 has a circumferential extent which is equal to or less than a circumferential extent of movement of the control element 750. Thus, the spacer connection trailing edge 726 determines the range of movement of the control element 750, alone or in co-operation with the engaging surfaces 733*a*, 733*b*.

Any of the described angled leading edge and/or a trailing edge extends over a part only of the longitudinal extent of a blank of sheet material wrapped around the rod articles. A section comprising an angled edge of the first or second part is configured to be rotatable relative to a longitudinally and/or radially adjacent section which is part of the other of the first or second part. A longitudinally adjacent section can refer to the same radial layer, e.g. initially attached as the same layer of the same blank.

Any section having an angled leading edge and/or a trailing edge can comprise at least one frangible connection adjacent to the angled edge. The adjacent frangible connection can be immediately adjacent to the angled edge, such that the angled edge extends up to the frangible connection. In some aspects, the angled edge can extend up to the longitudinal edge of the section defining the angled edge. In some examples, the frangible connection extends circumferentially from at least one longitudinal edge of the angled edge In some aspects, the section of sheet material defining the leading edge and/or a trailing edge is movable over an underlying area of the smoking article and/or movable over an underlying sheet material wrapped around a rod article of the smoking article. In some examples, the section of sheet material defining the leading edge and/or a trailing edge is movable underneath an overlying sheet material wrapped around a rod article of the smoking article.

In some aspects, the section of sheet material adjacent the leading edge and/or a trailing edge is not affixed to a radially adjacent, e.g. an underlying or overlying, part of the smoking article In some examples, the angled leading edge and/or a trailing edge is circumferentially spaced from a leading edge of a blank comprising the section defining the angled leading edge and/or a trailing edge. In some examples, the angled leading edge and/or a trailing edge is circumferentially spaced from a leading edge and/or trailing edge of a longitudinally adjacent section of blank. The circumferential spacing is such that the angled edge is discretely spaced, such that there is a circumferential spacing (non-zero) between the angled edge and a leading edge of the blank or section. In some examples, the angled leading edge does not extend up to a leading edge of the blank on which the angled edge is formed. The angled edge can be between a leading edge of the blank and a trailing edge of the blank. The angled edge is spaced from a leading edge of the blank and spaced from a trailing edge of the blank. Thus, the leading edge of a blank or a longitudinally adjacent section of blank, is wrapped prior to the angled leading edge and/or a trailing edge.

At least one edge on the first or second blank 701,700 has been described as angled, in particular, the first and second limiting surfaces 753*a*, 753*b*, first and second engaging surfaces 733*a*,733*b*, spacer connection trailing edge 726 and/or support section leading edge 721. The angled edge(s) can be considered as extending helically (i.e. in a helix, or spiral) when wrapped around the rod article(s). Thus, the angled edges extend both longitudinally and circumferentially.

The angle of the edge can be advantageous in wrapping the sheet material of the first or second blank 701,700 in an accurate tube (i.e. cylindrical tube) around the rod articles. In particular, the angle of the edge can prevent or reduce an extent to which the blank adjacent the edge has a cross-section which extends away from a tubular intent, i.e. a cylinder. For example, there is minimal tendency for the diameter of the wrapped blank to vary along the longitudinal axis. The diameter and cross-section of the wrapped blank are substantially constant. An angle of the edge provides an initial point of the edge which is wrapped before the remainder of the material defining the edge. As such, the material tends to follow the initial point, and wrap closely to the intended tubular (cylindrical) shape. This wrapping is of advantage when the material defining the edge is either adhering (e.g. with adhesive), or not adhering, to an underlying layer or rod article. The angled edge is spaced from a leading edge of the blank.

For example, an extent to which the material of the blank extends radially outwardly at an edge, between longitudinal extremes of the edge, can be reduced. In some aspects, the amount that the edge extends towards a tangent to a curvature of the rod articles is reduced. The angle of the edge is of particular advantage for edges which are not affixed to an inner layer, for example, the support section leading edge 721 or the first and second limiting surfaces 753*a*, 753*b* of the control element. The angled edge is also of advantage when overwrapped by a further layer of sheet material. In particular, the angled edge provides for close proximity of the angled edge to the cylindrical underlying surface, which assists in allowing a close proximity of the overlying layer to a cylindrical shape.

Figure 8:
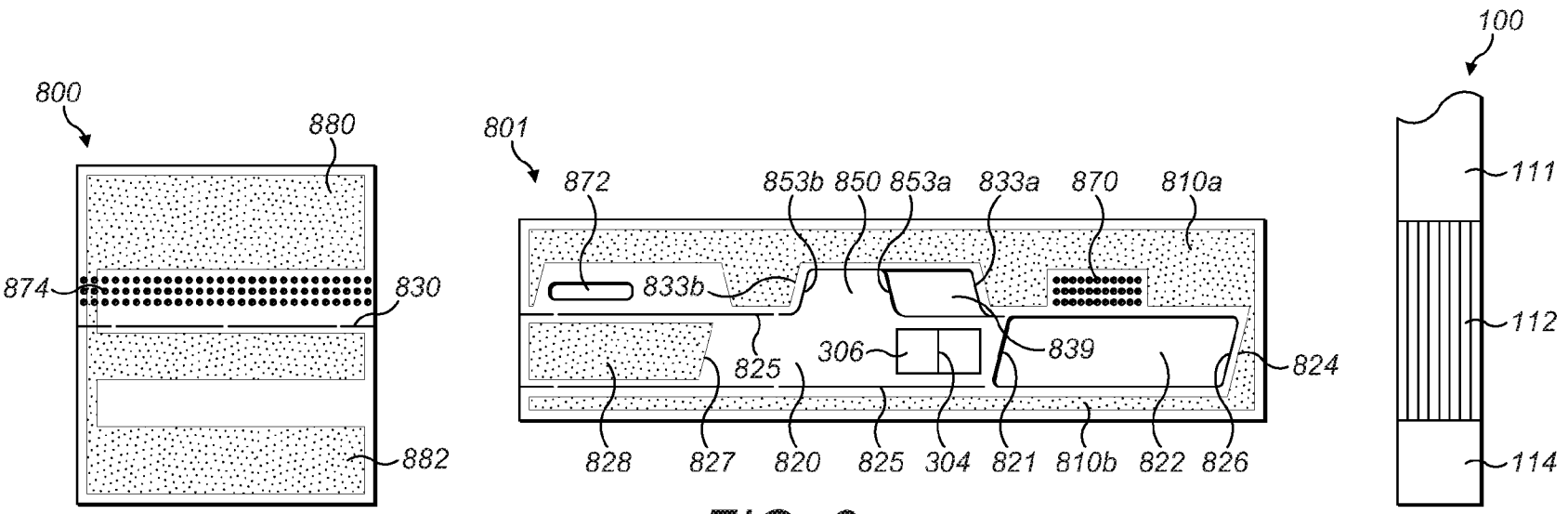
FIG. 8 is a plan view of blanks according to a fifth embodiment of the smoking article.

FIG. 8 shows a further embodiment of the first blank 801 and the second blank 800. The first and second blank 801,800 are configured and function substantially as described with respect to FIGS. 5 and 6, with the following differences. Equivalent reference numerals indicate the same parts.

The first blank 801 is configured to wrap three times around the rod articles. The first blank 801 comprises a control element 850 movable in a channel 839, configured to control ventilation and limit movement as described above. The control element 850 defines first and second limiting surfaces 853*a*, 853*b* at the edges of the control element in the direction of movement, i.e. at the circumferential edge of the control element 850. The first and second limiting surfaces 853*a*, 853*b* extend at an angle to a longitudinal axis of the smoking article. The angle of the first and second limiting surfaces 853*a*, 853*b* is as described above with respect to the first and second limiting surfaces of FIG. 7.

The first and second engaging surfaces 833*a*,833*b* also extend at an angle to the longitudinal axis of the smoking article, and/or at an angle to the axis of movement of the control element. The first and second engaging surfaces 833*a*,833*b* extend at the same angle and/or have a complementary shape to the first and second limiting surfaces 853*a*, 853*b*. The angle of the first and second engaging surfaces 833*a*,833*b* is as described above with respect to the first and second engaging surfaces 733*a*,733*b* of FIG. 7.

The first blank 801 comprises a support section 820. The support section 820 has substantially the same configuration and function as the support section 522 described with respect to FIG. 5. The support section 820 is attached to one or more (two as shown) spacing sections with frangible connections 825, namely, first and second spacing sections 810*a*,8100*b*. The support section 820 extends around at least one whole circumference of the rod articles 110. In particular, the support section 820 extends two times around the whole circumference of the rod articles 110, on the second and third layers of the wrapping of the blank 801. The outer (third) layer of the support section comprises adhesive 828 from a line 827, in order to affix to the middle (second) layer of the wrapping.

The support section 820 comprises a support section leading edge 821. The support section leading edge 821 defines the initial point of the support section 820 which is first wrapped around the rod articles 110. The support section leading edge 821 extends at an angle to a longitudinal axis of the smoking article. The angle and shape of the support section leading edge 821 are as described as with respect to the support section leading edge 721 of FIG. 7.

The first blank 801 comprises a spacer connection 824, connecting the first and second spacing sections 810*a*, 8100*b*. The spacer connection 824 is adjacent a leading edge of the first blank 701, i.e. the point on the blank 701 first wrapped around the rod articles 110. The spacer connection 824 is configured and functions in the same manner as the spacer connection 724 described with respect to FIG. 7.

The spacer connection 824 and longitudinally adjacent areas of the spacing sections 810*a*,810*b* are initially affixed to the rod articles to begin wrapping of the first blank 801, for example, with adhesive. The spacer connection 824 provides for the blank 801 to have a single initial area of attachment to the rod articles 110. The spacing sections 810*a*,810*b* are not affixed as independent elongate sections of sheet material, requiring separate attachment to the rod articles. Thus, the connection of the leading edges of the spacing sections 810*a*,810*b* improves initial attachment of the first blank 801 to the rod articles.

The spacer connection 824 has a trailing edge 826 at a circumferentially opposite end of the spacer connection 824 to the leading edge. The spacer connection trailing edge 826 extends between the first and second spacing sections 810*a*, 8100*b*. The spacer connection trailing edge 826 extends at an angle to a longitudinal axis of the smoking article. The spacer connection trailing edge 826 is shaped and configured as described as described with respect to the spacer connection trailing edge 726 in FIG. 7.

The spacer connection trailing edge 826, support section leading edge 821 and first and second spacing sections 810*a*,810*b* define an aperture 822 in the first blank 801. The aperture 822 provides a space in which the support section 820 is movable.

In some examples, the aperture 822 has a circumferential extent which is greater than a circumferential extent of movement of the control element 850. Thus, the spacer connection trailing edge 826 does not determine the range of movement of the control element 850.

The first blank 801 comprises a first and second ventilation area 870,872 on the first and third layers of the blank. The first and second ventilation area 870,872 are configured the same, and provide the same function, as the ventilation areas 570,572 described with respect to FIG. 5.

The second blank 800 comprises a frangible connection 830 allowing separation of the blank into a forward area 880 and a rearward area 882.

The forward area 880 comprises a third ventilation area 874. The third ventilation area 874 is configured the same, and provides the same function, as the ventilation area 670 described with respect to FIG. 6.

The forward area 880 is arranged to attach to the first spacing section 810*a*. An area of the forward area 880 defining the third ventilation area 874 and overlying the control element is not affixed to the first blank. The rearward area 882 is affixed to the support section 820 and second filter section 114. The rearward area provides a connection between the second filter section 114 and the first filter section. The connection includes the support section which is movable circumferentially, and restrained longitudinally by the spacing sections 810*a*,810*b*, such that the second filter section 114 has the same range of movement.

The rearward area 882 extends over, and is not affixed to, the second spacing section 810*a*. As also applicable to other embodiments, the outermost layer 800 of the blanks wrapped around the rod articles provides the only connection between the first and second filter sections. The attachment of the outermost layer to the first filter section is through a section (e.g. the support section 820) which is restrained by an adjacent, separable, part of the blank in a longitudinal direction. In addition, the contact of the section to the second section with an exterior of a spacing section provides for radial positioning of the first and second indexing surfaces. Features of the second blank 800 are applicable to the blank 600 described with respect to FIG. 6, or to any related embodiment with a single wrap outer (second) blank, and vice versa. The terms "forward" and "rearward" to describe areas of the second blank 800 can be reversed in an alternate embodiment.

Figure 9:
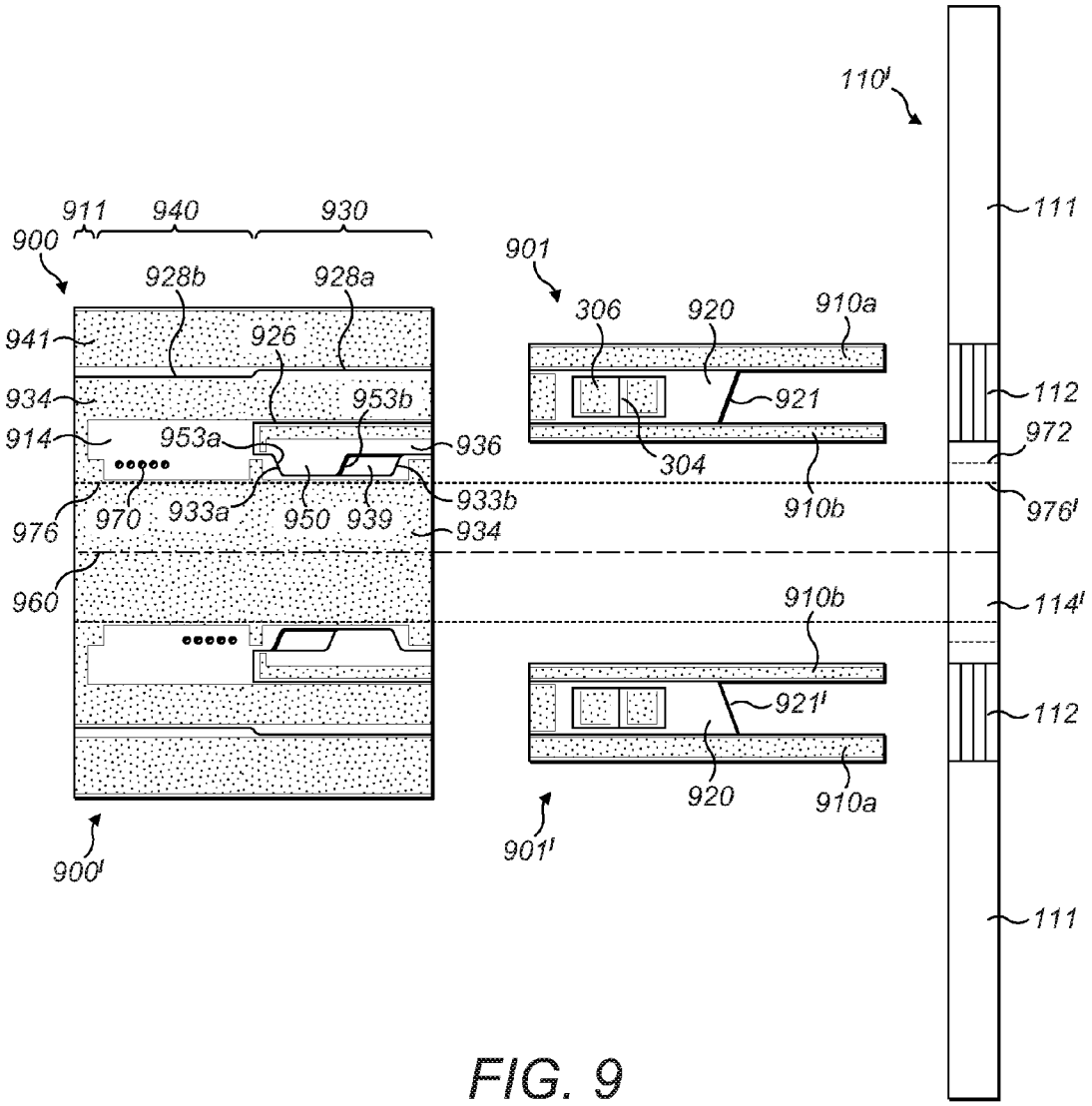
FIG. 9 is a plan view of blanks and rod articles according to a sixth embodiment of the smoking article.

FIG. 9 shows a further embodiment of the first blank 901,901' and the second blank 900. The first and second blanks 901,901',900 are configured and function substantially as described with respect to FIGS. 1 to 4, with the following differences. Equivalent reference numerals indicate the same parts. The first and/or second blanks are each arranged to wrap a plurality of times around the whole circumference of the rod articles. Thus, the smoking article comprises one or more tubes having a plurality of complete integrally attached layers (e.g. two layers).

The second blank 900 is shown as half of a blank 900' configured to manufacture two smoking articles. The blank 900' is arranged to be cut along a line 960. The blank 900' comprises two second blanks 900. The two blanks 900 are configured to function substantially the same when wrapped around rod articles 110' for the manufacture of two smoking articles.

Two separate first blanks 901,901' are also shown, for attachment to the rod articles 110' and second blank 900'. In particular, the two first blanks 901,901' and rod articles 110' are symmetrical about the cut line 960.

A ventilation aperture 970 and/or a control element 950 on each second blank 900 are arranged on the blank 900' as shown, such that the initial direction of movement and initial ventilation is the same on the two final smoking articles. For example, the arrangement of the ventilation aperture 970 and/or a control element 950 is asymmetric, e.g. asymmetric in reflection about the separation line 960. The shape and function of the ventilation aperture 970 and a control element 950 are substantially as described with respect to FIG. 7 or any other related embodiment, although arranged differently as will be described.

The rod articles 110' comprise a double length second filter section 114', configured to be cut in half through cut line 960. The cut double-length filter section 114' provides two second filter sections. The further rod articles comprise two first filter sections 112 and two tobacco rods, arranged symmetrically. Each first filter section 112 and tobacco rod is dimensioned for a single smoking article. The second blank 900 and second filter section 114' are cut after wrapping of the first and second blanks 901,900 around the rod articles 110'.

The first blank 901,901' is substantially as described with respect to any of FIGS. 1 to 4 or FIG. 7. The first blank 901,901' (or the second blank) of any embodiment can comprise any feature(s) described in any embodiment, independently of any other feature. For example, the first blank 901,901' comprises an angled leading edge 921,921' on the support section 920 substantially as described with respect to the angled leading edge of the support section in FIG. 7. The angled leading edges 921,921' differ in the orientation of the angle to the longitudinal axis. The magnitude of the angle from the longitudinal axis are the same. The leading part of the angled leading edges 921,921' are both attached to the first spacing section 910*a*. Alternatively, the leading part of the angled leading edges 921,921' are both attached to the second spacing section 910*b*, or to a different one of the first and second spacing sections 910*a*,910*b*, or extend parallel to the longitudinal axis.

The first blank 901 comprises first and second spacing sections 910*a*,910*b* which are unconnected at their leading edges, substantially as described in FIG. 2. The first spacing section 910*a* is defined as longitudinally forward (in the finished smoking article) of the second spacing section 910*b*. Alternatively, the first and second spacing sections 910*a*,910*b* can be connected by a spacer connection, as described in FIG. 7.

The second blank 900 comprises the control element 950. The control element 950 is moveable in a channel 939 and controls ventilation as described with respect to the control element shown in FIG. 3 or 7. The control element 950 comprises first and second limiting surfaces 953*a*, 953*b* at the edges of the control element in the axis of movement, i.e. at the circumferential edge of the control element 950, as described above. Contact of the first and second limiting surfaces 953*a*, 953*b* of the control element 950 between a first engaging surface 933*a* (as shown) and a second engaging surface 933*b* limits relative rotation between the first and second parts. The first and second engaging surfaces 933*a*, 933*b* and first and second limiting surfaces 953*a*, 953*b* are as described in any embodiment, and for example, can be angled as described with respect to FIG. 7.

The second blank 900 is arranged to form a first layer and a second layer when wrapped a plurality of times around a whole circumference of the smoking article. The second blank 900 is wrapped two times around the rod articles. The first layer and second layer are integrally formed. Thus, a single blank provides two (or more) complete layers.

The control element 950 is part of (e.g. integral with) a control element support section 936. The control element support section 936 is arranged on the blank 900 as part of an inner layer 930 when wrapped around the rod articles. The control element support section 936 extends around a whole circumference of the rod articles, for example, only one whole circumference. The control element support section 936 is a tube, from which the control element 950 extends. The control element 950 extends longitudinally from the tube, for example, in the same plane or radial layer as the tube.

An initially integral outer layer 940 of the blank 900 comprises an overlying section 914. The overlying section 914 is configured to overlie the control element 950. The overlying section 914 extends around the whole circumference of the smoking article, e.g. is a tube. The overlying section 914 allows the control element support section 936 to move (i.e. rotate) underneath, to vary ventilation. The overlying section 914 is not affixed to the control element support section 936, e.g. is not provided with adhesive on an inner facing surface. The overlying section 914 is initially integral with the control element 950 and control element support section 936, and is separable therefrom.

The overlying section 914 comprises a ventilation area 970 configured to coincide with the control element 950 and/or channel 239. The control element 950 is movable to selectively cover a variable part (area) of the ventilation area 970. In some examples, the ventilation area 970 comprises a plurality of discrete ventilation areas, for example, a plurality of discrete apertures spaced circumferentially. The ventilation area 970 is aligned with a ventilation area 972 on the rod articles, for example, on the second filter section 114' for each smoking article. In some aspects, it is more straightforward to form a ventilation area 972 on the second filter section, rather than on the grooves and ridges of the first filter section.

The single layer of the control element support section 936 around the circumference is in contrast to the blank 200 described with respect to FIG. 3 in which the control element support section 236 is integral during use with a section on the outer layer. The control element support section 936 is otherwise similar to the control element support section 236, except as described, and features of the control element support section 236 can also apply to the control element support section 936.

The control element support section 936 is attached to the first part of the smoking article. For example, the control element support section 936 is affixed to one of the first and second spacing sections 910*a*,910*b*. As a part of the first part of the smoking article, the control element support section 936 and control element is in a fixed relationship with the first indexing surface on the rod article (first filter section) and/or source of smokable material. The second indexing surface (pawl) is movable relative to the control element support section 936 and control element 950. Thus, the control element support section 936 and control element 950 are considered a part of the first part of the smoking article, movable relative to the second indexing surface on the second part of the smoking article. Alternatively, the definitions of first part and second part can be reversed, such that the control element is always on the second part of the smoking article. This is in contrast to the embodiment of FIGS. 1 to 8, where the control element is connected, or moves together with, the second indexing surface.

The control element 950 is on a longitudinally rearward side of the control element support section 936. This in contrast to the embodiments of FIGS. 2 to 8, where the control element is on a longitudinally forward side of the control element support section. The embodiment of FIG. 9 can be considered as an "inverted" arrangement.

The control element 950 is arranged to overlie a mouth end section or rod article of the smoking article. In particular, the control element 950 is arranged to overlie a mouth end section or rod article which is movable relative to the control element 950. The mouth end section can be a rod article, in particular, the second filter section. Alternatively, the mouth end section can be a hollow tube. The hollow tube can be considered as an example of a rod article.

The control element support section 936 does not overlie the mouth end section of the smoking article. Instead, the control element support section 936 overlies a relatively forward section or rod article, which is movable relative to the mouth end section. The control element support section 936 is attached to the underlying rod article. The control element support section 936 can be considered as a part of the spacing section. The integral control element support section 936 and control element 950 extend over an interface between two underlying sections or rod articles. The control element 950 allows ventilating air into the rearward rod article, or mouth end rod article, e.g. which is movable relative to the first part of source of smokable material. Thus, this arrangement allows a position of intake of ventilating air to a relatively rearward location. The control element 950 overlies the second filter section, and in some aspects, provides for control of ventilating air into the second filter section.

The blank 900 further comprises a connecting section 934 which extends longitudinally forward and rearward of the control element support section 936. The connecting section 934 can be considered as extending integrally on both the inner and outer layers 930,940, forward and rearward of the control element support section 936. The overlying section 914 can be considered as part of the connecting section 934. The connecting section 934 is a part of the second part of the smoking article.

The blank 900 further comprises a forward section 941 which extends integrally over both the inner and outer layers. The forward section 941 overlies and is attached to the first spacing section 910*a*. The forward section 941 is a part of the first part of the smoking article. The forward section 940 optionally has the function of connecting the first filter section 112 to the tobacco rod 111.

The control element support section 936 and control element 950 are attached to the connecting section 934 (and overlying section 914) by a frangible connection 926. The frangible connection 926 extends circumferentially at two longitudinally spaced positions on each longitudinal side of the control element support section 936, and a further longitudinally spaced position to define the control element 950. The frangible connection 926 extends longitudinally to separably connect to the overlying section 914. The control element support section 936 and control element 950 is separable from the adjacent areas of the blank forming the inner layer, and the adjacent area of the blank forming the integral outer layer.

An interface between the first and second parts of the smoking article is offset between the inner and outer layers 930,940. This can reduce leakage of air through the interface between the first and second parts. The forward section 941 is attached to the connecting section 934 by an inner frangible connection 928*a* on an inner layer and an outer frangible connection 928*b* on an outer layer. The inner and outer frangible connections 928*a*,928*b* extend circumferentially, and are longitudinally offset.

In some examples, the inner layer and outer layer of an initially integral blank are movable relative to each other. In some aspects, the inner layer and outer layer move apart at the frangible connection separating the inner layer and outer layer. In other aspects, the inner layer and outer layer move together, with the outer layer riding over and around the inner layer. In some examples, a cut-out can be provided, such that the inner layer is moveable into the cut-out. This avoids the need for the outer layer to move radially outwardly over an edge defined by the frangible connection of the inner layer. Any embodiment can comprise a cut-out at an interface between a section on the inner layer movable relative to a corresponding section on the outer layer.

The connecting section 934 is arranged to attach to the second indexing surface 304. In some aspects, the connecting section 934 is affixed to the support section 920 on the first blank 901,901' supporting the second indexing surface 304. The connecting section 934 also defines the first and second engaging surfaces 933*a*,933*b*. The connection to the support section 920 and first and second engaging surfaces 933*a*,933*b* are on opposite longitudinal sides of the control element support section 936.

The connecting section 934 also surrounds and attaches to the second filter section 114'. The connecting section 934 provides a connection between the second filter section and first part of the smoking article (e.g. first filter section). The connection allows relative rotational but not longitudinal movement. The connecting section 934 provides a connection to the second filter section which is only through an outermost layer of the first and second blanks 901,900.

The connecting section 934 and overlying section 914 define an outer mouth end part of the smoking article. Rotation of this outer mouth end part relative to the tobacco rod effects movement between the first and second parts of the smoking article. In particular, the second filter section, connecting section 934, support section 920 and second indexing surface rotate together. Thus, the first and second engaging surfaces 933*a*,933*b* and ventilation area 970 rotate together with the second filter section. The second indexing section indexes with the first indexing surface on the first filter section. The control element 950 remains in the fixed relation with the tobacco rod, and so relative to the tobacco rod, the first and second engaging surfaces 933*a*,933*b* and ventilation area 970 rotate relative to a stationary control element 950.

The connecting section 934 and overlying section 914 are integral and can be considered as a single section overlying at least one spacing section and configured to support the second indexing surface in a pre-determined radial position (i.e. a constant position, partially spaced apart) relative to the first indexing surface. In particular, the connecting section 934 and overlying section 914 support the second indexing surface adjacent and longitudinally of at least one spacing section. The overlying section 914 contacts an exterior surface of the control element support section 936, which is affixed to the second spacing section 910*b*. Thus, the control element support section 936 has a spacing function, and can be considered as a further part of the second spacing section 910*b*. The contact of the overlying section 914 with the control element support section maintains the overlying section 914 at a constant, or minimum, radial position, maintaining a minimum separation of the first and second indexing surfaces.

A further function of the control element support section 936 is to provide one or more contacting surfaces arranged to limit or prevent longitudinal movement between the first and second parts of the smoking article. The contacting surface is a circumferentially extending raised edge on a forward side of the control element support section 936. The raised edge is the thickness of the sheet material forming the blank 900. The contacting surface extends around the whole circumference of the smoking article. The contacting surface preventing separation of the second filter section is on an opposite longitudinal edge to the control element 950. Thus, the second filter section is securely attached to the first part of the smoking article.

The contacting surface is arranged to engage with a further contacting surface of the connecting section 934. The further contacting surface of the connecting section 934 is also on the inner layer 930 of the blank, and/or extends around the whole circumference of the smoking article. The two contacting surfaces are initially integrally formed on the blank 900, and subsequently divided to allow circumferential movement. In some aspects, the contacting surfaces limiting or preventing longitudinal movement are initially integrally formed on the same wrapped layer of a blank comprising a plurality of layers when wrapped. The connecting section 934 extends around the contacting surfaces.

In some examples, the second blank 900 provides for a base ventilation. The area of the base ventilation is independent of the position of the control element. The second blank comprises a base ventilation area 976. The base ventilation area 976 extends circumferentially, e.g. through both the inner and outer layers 930,940. The base ventilation area 976 is located in the connecting section 934, e.g. rearwardly of the control element 950 and ventilation area 970. The base ventilation area 976 comprises a plurality of circumferentially spaced ventilation apertures. The base ventilation area 976 extends around the whole circumference of the smoking article. Base ventilating air is arranged to enter the second filter section 114'. The second filter section 114' comprises an aligned base ventilation area 976'.

Figure 10:
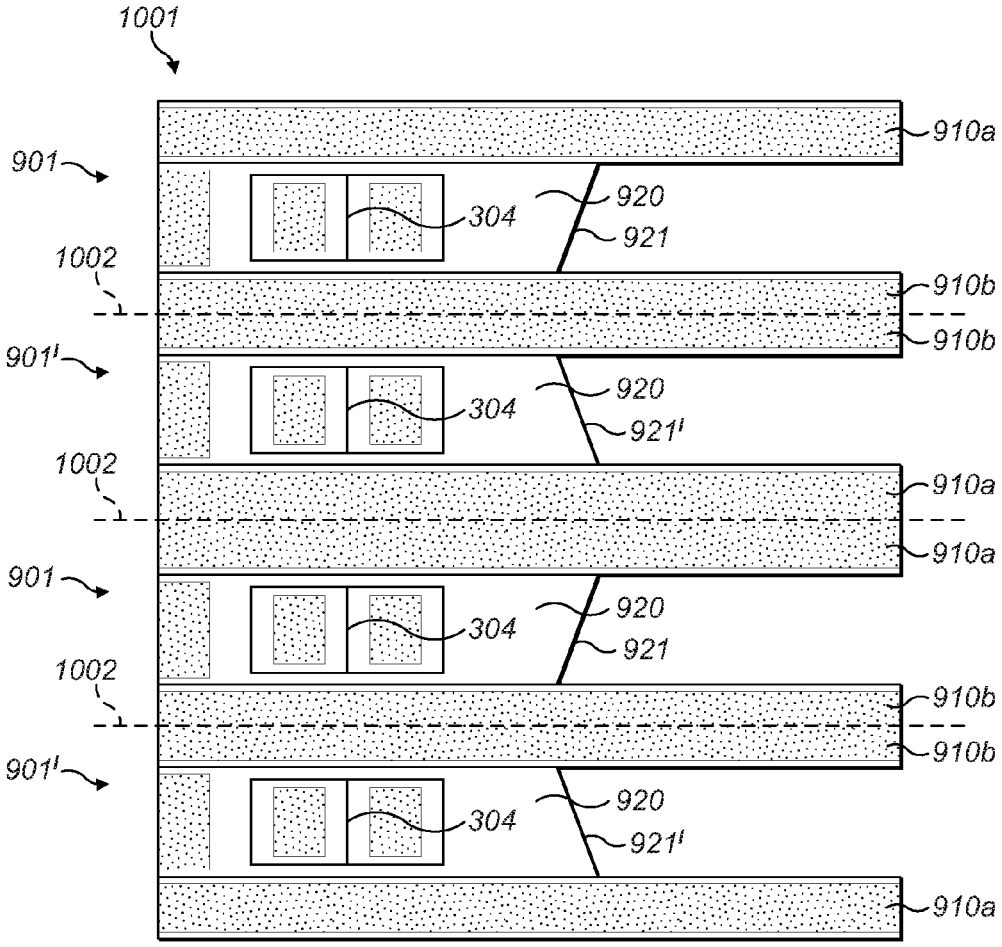
FIG. 10 is a plan view of a blank according to a seventh embodiment of the smoking article.

The functioning of the smoking article comprising the wrapped blanks 900,901 is substantially the same as described with respect to FIGS. 1 to 8, in that the control element 950 selectively covers the ventilation area 970 and limits rotation by engagement with the first and second engaging surfaces 933*a*,933*b*. Thus, the embodiment of FIG. 9 functions in a similar manner to the embodiments of FIGS. 1 to 8, although the control element 950 on the second blank 900 and second indexing surface on the first blank 901 are movable relative to each other. FIG. 10 shows a blank 1001 configured to be cut into a plurality of first blanks 901,901'. The first blanks 901,901' are as described in FIG. 9. In particular, the blank 1001 is arranged to be cut into four blanks 901,901'. The blank 1001 is configured with four sets of features of the blank 901, 901'. The blank 1001 can be cut along three cut lines indicated by lines 1002. In an example method of manufacture, the blank 1001 is wrapped around and affixed to a rod article (not shown) configured to form four first filter sections 112. The blank 1001 and rod article are cut together at the locations 1002 to provide four identical or similar wrapped first filter sections. The wrapped first filter section can be aligned with further rod articles, and wrapped with the second blank 900 to form one or more smoking articles.

Each blank 901 comprises a first spacing section 901*a* and a second spacing section 901*b*, as described above. The first spacing section 901*a* has a width, in a longitudinal direction of the smoking article, which is larger than a width of the second spacing section 900*b*. The blank 1001 comprises elongate sections of sheet material configured to provide a first or second spacing section 901*a*,901*b*, or a combination of two of the spacing sections 901*a*,901*b* in any combination. The blanks 901 are arranged with two second spacing sections 900*b* adjacent to each other, arranged to be separated by a cut line 1002. The blank 1001 also comprises two adjacent first spacing sections 901*a*.

The blank 1001 is arranged such that the leading edges 921,921' of the support sections 920, as described above, are angled such that a part of the edge 921,921' is wrapped prior to another part of the edge 921, 921'. In an alternative example, the edges 921, 921' are angled such that the part of the edge 921,921' wrapped initially is adjacent a narrower of the elongate sections forming the first and or second spacing sections 901*a*,901*b*. This provides additional material of the support section 920 adjacent to the narrow of the elongate sections forming the first and or second spacing sections 901*a*,901*b*. Alternatively, the edges 921,921' can be angled in a different configuration. The angled edges 921, 921' are angled as described with respect to the angled edges of any embodiment, in particular, as described with respect to FIGS. 7 and 9.

The blank 1001 is configured to provide first blanks 901 with edges 921 angled in opposite senses, for use in manufacturing two smoking articles together with the arrangement shown in FIG. 9. Alternatively, the blank 1001 can be configured to provide a plurality of identical first blanks 901;901', or blanks similar to first blanks 901,901' with different orientations of the angled edges 921,921' in relation to the first and second spacing sections 910*a*,910*b*.

The blank 1001 is configured to be cut into four blanks 901,901'. Alternatively, the blank 1001 is configured to be cut into a plurality of blanks, of any number. For example, the blank 1001 can be configured to be cut into 2, 4 or 6 identical or similar blanks, or into one each of two similar (but different) blanks.

Figure 11:
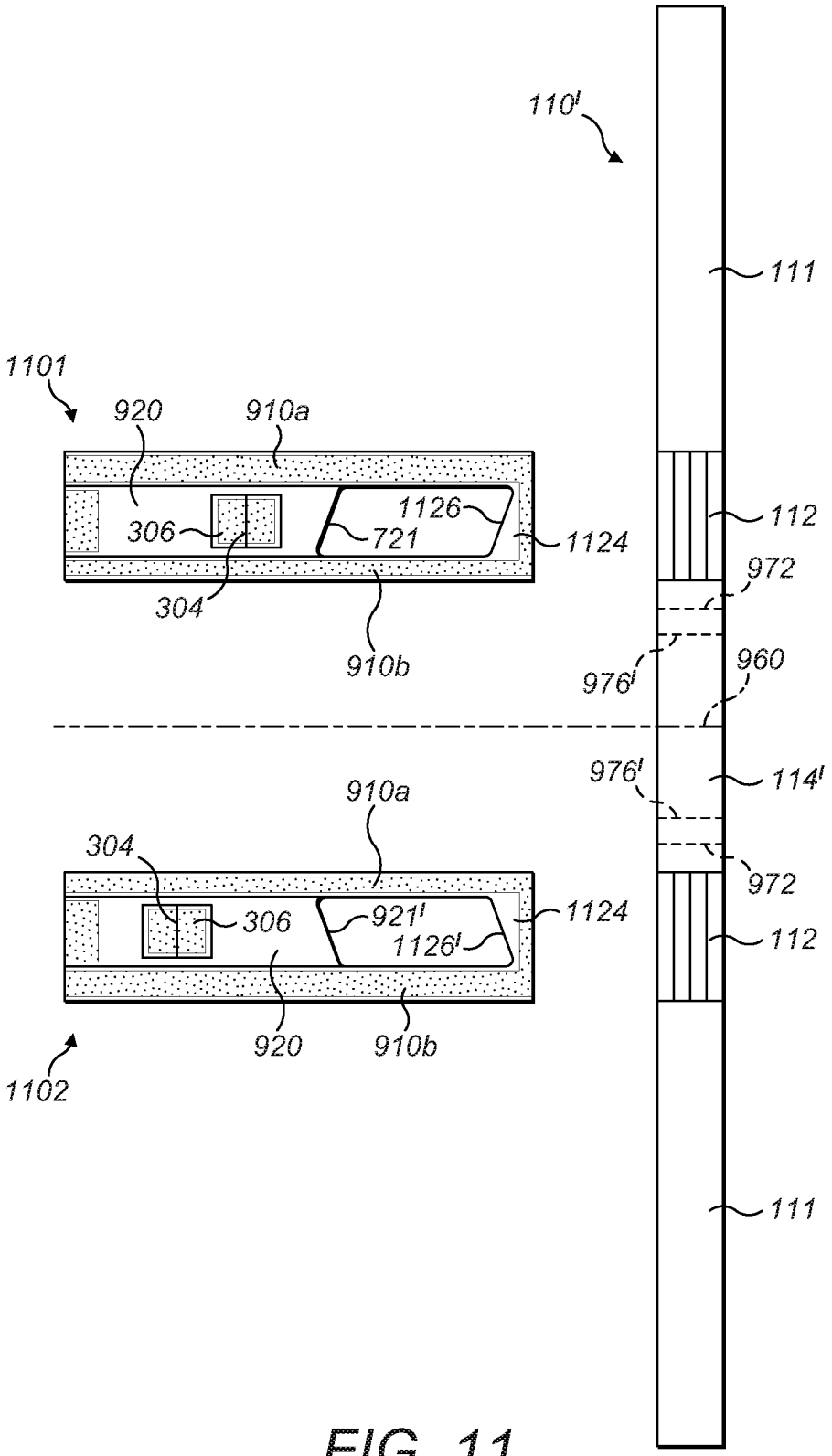
FIG. 11 is a plan view of blanks according to an eighth embodiment of the smoking article.

FIG. 11 shows two examples of a first blank 1101,1102. The blanks 1101,1102 are configured and function substantially as described with respect to FIG. 9, with the following differences. The first blanks 1101,1102 are configured to wrap around two sets of rod articles 110', and be wrapped with two sets of second blanks 900', as described with respect to FIG. 9. Equivalent reference numerals indicate the same parts.

The first blanks 1101,1102 comprise a leading edge of the first and second spacing sections 910*a*,910*b* which is connected together. A spacer connection 1124 connects the leading edge, as described with respect to the spacer connection 724 described with respect to FIG. 7. A trailing edge 1126,1126' of the spacer connection 1124 is angled to a longitudinal axis of the smoking article, as described with respect to the angled edge 726 described with respect to FIG. 7. The orientation of the trailing edge 1126,1126' of the spacer connection 1124 is parallel to the leading edges 721,721' of the support sections 920,921'.

Each first blank 1101 comprises a second indexing surface support unit 306, also termed a pawl support unit, as described with respect to FIG. 2. The second indexing surface support unit 306 is affixed to the sheet material forming the first blanks 1101,1102. The second indexing surface support unit 306 comprises the second indexing surface or pawl 304. The second indexing surface 304 is arranged in a different location on the separate first blanks 1101,1102.

Both smoking articles are configured to rotate in the same sense to obtain the same variation in ventilation. To provide this, one of the support sections 920 needs to rotate over the spacer connection 1124. The positioning of the pawl 304 is such that the pawl 304 does not travel over the spacer connection 1124. In the example shown in FIG. 11, the lower blank 1102 has a support section 920 which moves to the right into the cut-out or space between the angled edges 721',1126'. The upper blank 1101 has a support section 920 which moves to the left, moving radially over the spacer connection 1124. The pawl 304 is spaced apart from an edge of the support sections 920 which leads in a direction of travel in use, i.e. the left edge as shown. Thus, the pawl 304 is not required to move over the spacer connection 1124. As an option, the pawl 304 on the blank 1102 can have this same position.

Figure 12:
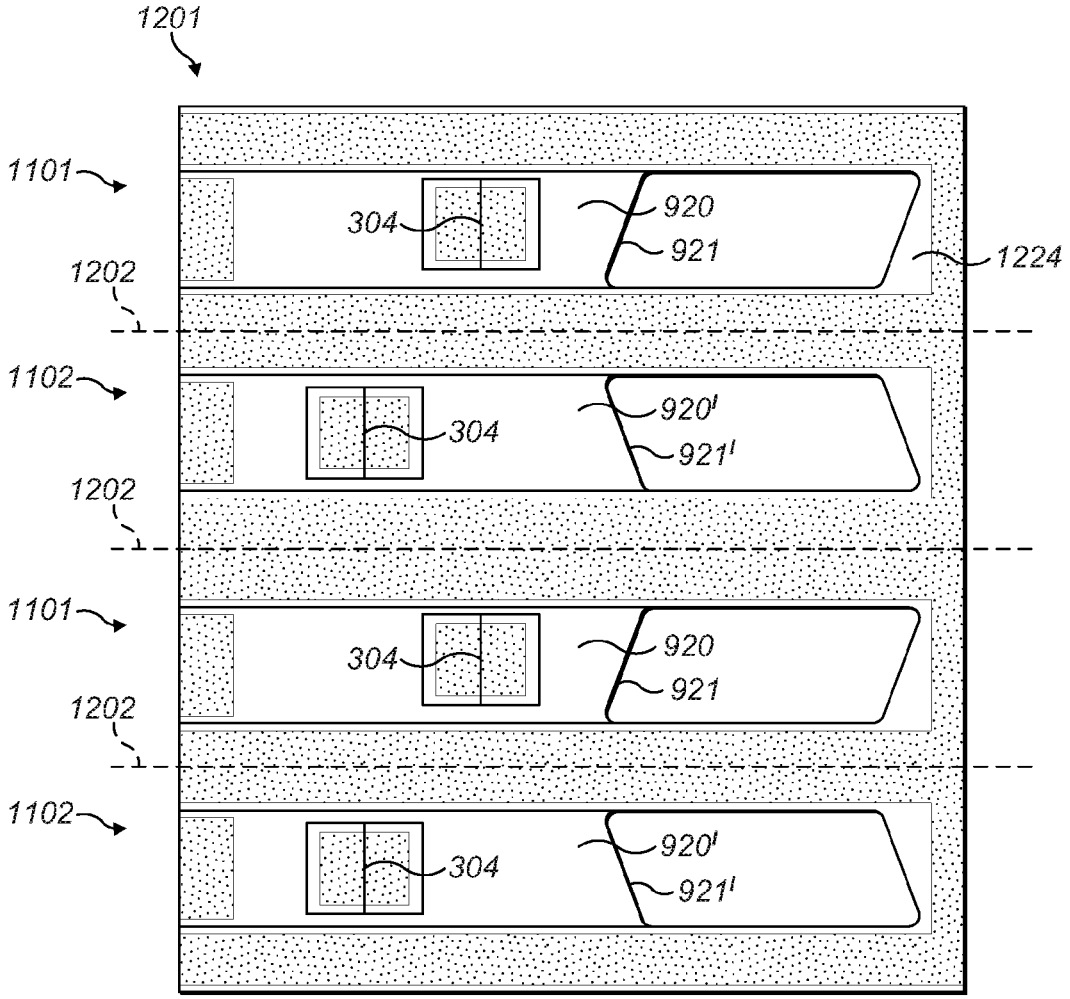
FIG. 12 is a plan view of a blank according to a ninth embodiment of the smoking article.

FIG. 12 shows a blank 1201 configured to be cut into a plurality of first blanks 1101, 1102 as described in FIG. 11. In particular, the blank 1201 is arranged to be cut into four blanks 1101,1102, two of each type. The blank 1201 is configured with four sets of features of the blanks 1101, 1102. The blank 1201 can be cut along three cut lines indicated by lines 1202. In an example method of manufacture, the blank 1201 is wrapped around a rod article (not shown) configured to form four first filter section 112. The blank 1201 and rod article are cut together at the locations 1202 to provide a wrapped first filter section. The wrapped first filter section can be aligned with further rod articles, and wrapped with a second blank, e.g. as described with respect to FIG. 9 or 11, to form one or more smoking articles.

A leading edge 921,921' of the support section 920 is angled to a longitudinal axis, substantially as described with respect to any of FIGS. 7 to 11. The angled edges can alternate in direction, as shown. Alternatively, the angled edges can be arranged differently, for example as described with respect to FIG. 10. The position of the second indexing support section 304 can optionally alternate in position on the similar (but different) types of first blank 1101,1102, as described with respect to FIG. 11.

The blank 1201 has a leading edge comprising a spacer connection 1224 configured to be cut into spacer connections 1124 for each blank 1101,1102. The spacer connection 1224 is configured as a plurality of the spacer connections 1124 described with respect to FIG. 11.

Figure 13:
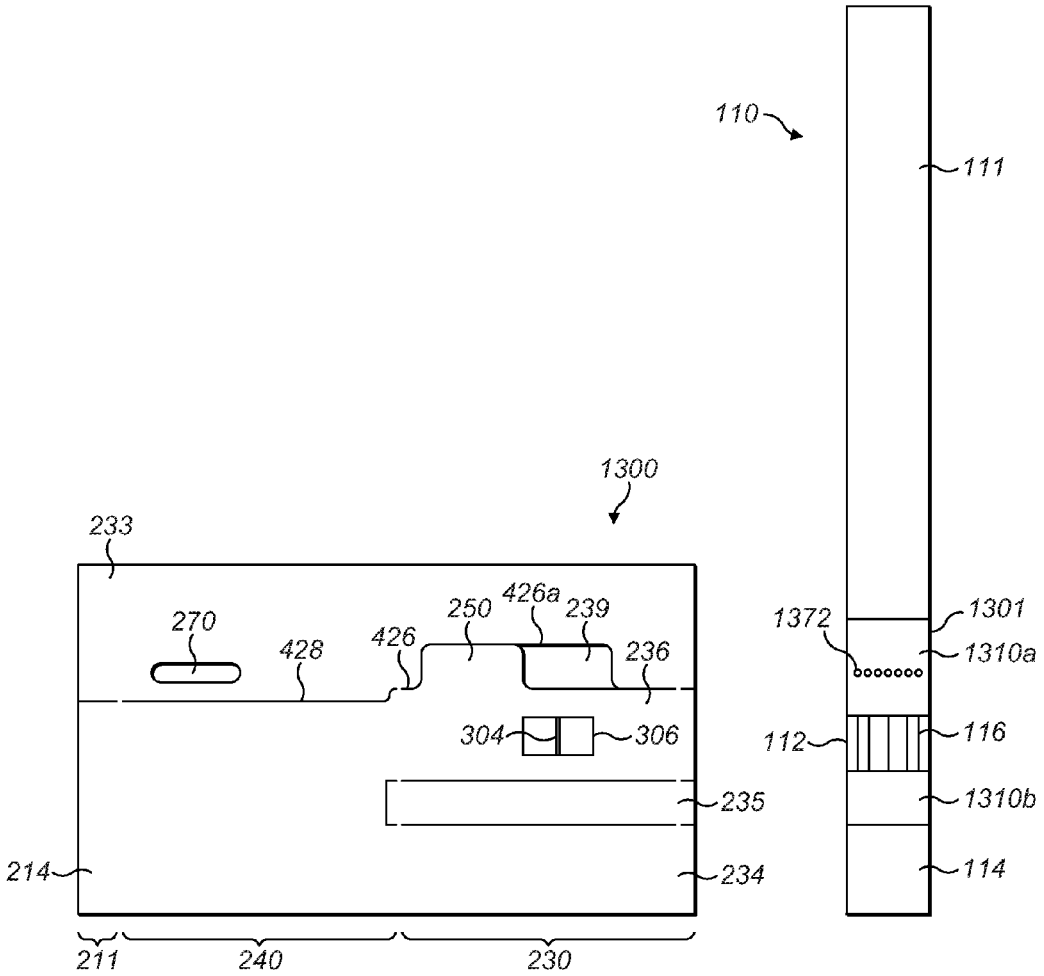
FIG. 13 is a plan view of a blank and rod articles according to a tenth embodiment of the smoking article.

FIG. 13 shows a further embodiment of second blank 1300, configured to be wrapped as the outer two layers around one or more rod articles. FIG. 13 also shows rod articles 110 as described above, already wrapped with a first blank 1301. The first and second blank 1301,1300 are configured and function substantially as described with respect to FIGS. 1 to 4, in particular FIG. 4, with the following differences. Equivalent reference numerals indicate the same parts.

The rod articles 110 are wrapped with the first blank 1301, which comprises first and second spacing sections 1310*a*, 1310*b*. The first and second spacing sections 1310*a*,1310*b* are arranged and function substantially as described above for first and second spacing sections, e.g. as described in FIGS. 2 and 3. The first and second spacing sections 1310*a*,1310*b* are wrapped around the first filter section 112, providing access therebetween to the first indexing surface 116.

In the example shown, the first blank 1301 comprises only the first and second spacing sections 1310*a*,1310*b*. In one aspect, the first and second spacing sections 1310*a*,1310*b* are initially separate, and are attached individually. Alternatively, the first and second spacing sections 1310*a*,1310*b* are connected together prior to wrapping, for example, by the spacer connection 724.

In some aspects, the first and second spacing sections 1310*a*,1310*b* are not initially affixed to a support section for supporting the second indexing surface. Instead, the second indexing surface support unit 306, and second indexing surface (pawl) 304, are affixed to the second blank 1300. For example, the second indexing surface (pawl) 304 is affixed to the same section of blank 1300 which comprises the control element 250. Thus, the second indexing surface and control element are arranged to move together relative to the first indexing surface.

The first blank 1301 comprises a ventilation area 1372. The ventilation area 1372 is formed in the first spacer section 1310*a*. In some aspects, the first spacing section 1310*a* is wrapped around the rod articles 110, and then the ventilation area 1372 is formed in the first spacer section 1310*a*. Thus, the ventilation area 1372 is only formed after the first spacer section 1310*a* is wrapped around the rod articles 110. For example, the ventilation area 1372 is formed by a laser generating a series of apertures in the first spacer section 1310*a*. Alternatively, the ventilation area 1372 is formed prior to wrapping of the first spacing section 1310*a*.

Figure 14:
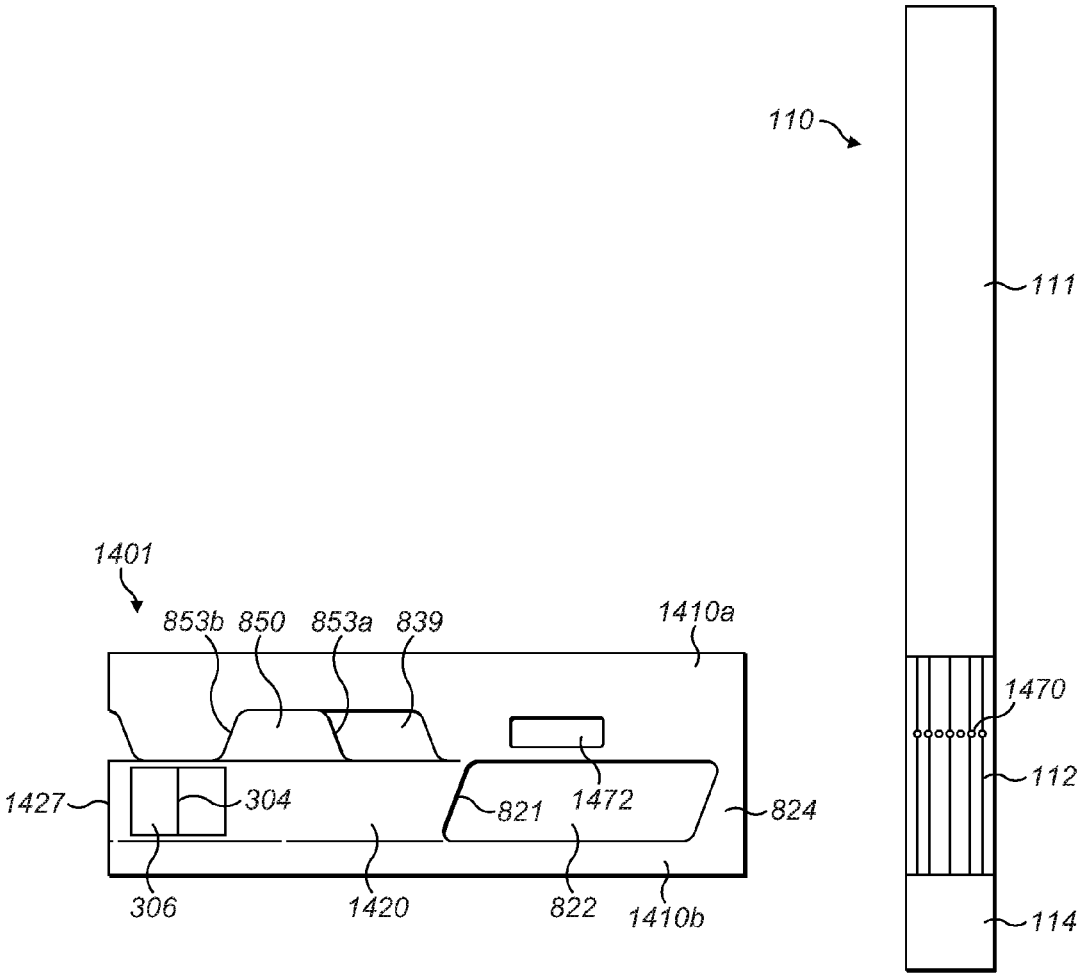
FIG. 14 is a plan view of a blank and rod articles according to an eleventh embodiment of the smoking article.

FIG. 14 shows a further embodiment of first blank 1401, configured to be wrapped around one or more rod articles. The first blank 1401 is configured and functions substantially as described with respect to FIG. 8, with the following differences. Equivalent reference numerals indicate the same parts. The first blank 1401 is configured to be overwrapped with a second blank, for example the second blank 800 described with respect to FIG. 8.

The first blank 1401 is configured to wrap two times only around the whole circumference of the rod articles. The inner and outer layer correspond to the inner and middle layers formed by the blank 500 in FIG. 5, or the blank 801 in FIG. 8. In particular, the outer layer provided by the blank 500 in FIG. 5, or the blank 801 in FIG. 8 is not present in the blank 1401. The part of the blank 500 in FIG. 5, or the blank 801 in FIG. 8 forming the third and outer layer is optional. In particular, the blank 500 in FIG. 5 comprises a ventilation area 570 on the inner layer 510, which is arranged to be covered by the control element 550. The third outer layer comprises a further ventilation area 572 coinciding with the ventilation area 570. However, in the blank 1401 the further ventilation area is omitted.

The first blank 1401 comprises first and second spacing sections 1410*a*, 1410*b*, substantially as described in FIG. 8. The first and second spacing sections 1410*a*, 14100*b* are optionally connected by a spacer section 824. The first and second spacing sections 1410*a*, 1410*b* extend circumferentially over the two layers of the first blank 1401.

The first blank 1401 comprises a support section 1420, supporting the second indexing surface 304. The support section 1420 extends one time around the whole circumference of the smoking article, e.g. to form a tube. A trailing edge 1427 of the support section 1420 extends substantially parallel to the longitudinal axis of the smoking article.

The area of blank 1401 forming the inner layer, e.g. on the first spacing section 1410*a*, comprises a ventilation area 1472. In some examples, the ventilation area 1472 comprises a single aperture. Alternatively, the ventilation area 1472 comprises a plurality of discrete permeable areas or apertures.

In some aspects, one of the rod articles 110 comprises a further ventilation area 1470. For example, the first filter section 112 comprises the further ventilation area 1470. The ventilation area 1472 is arranged to at least partially coincide with the further ventilation area 1470. The further ventilation area 1470 comprises a plurality of discrete ventilation areas or apertures, for example, in a circumferentially extending line. The further ventilation area 1470 can be formed by a laser. Generally, one or more of the ventilation areas 1470,1472 comprise a plurality of discrete ventilation areas or apertures.

Figure 15:
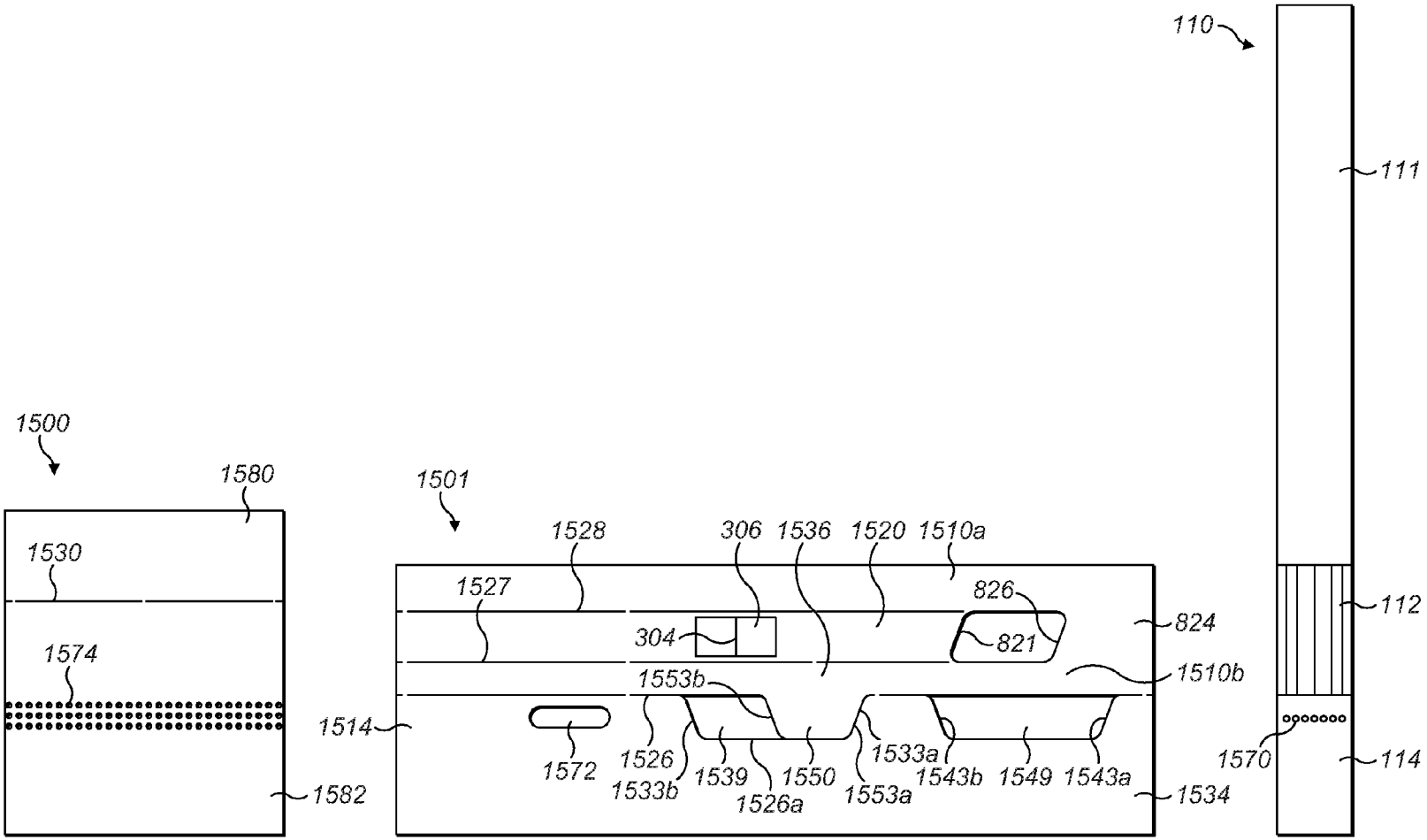
FIG. 15 is a plan view of blanks and rod articles according to a twelfth embodiment of the smoking article.

FIG. 15 shows a further embodiment of a first blank 1501 and a second blank 1500, configured to be wrapped around one or more rod articles 110. The first blank 1501 is configured and functions in a similar manner to the embodiment described with respect to FIG. 8, with an arrangement related to the embodiment of FIG. 9, with the following differences. Equivalent reference numerals indicate the same parts. The first blank 1501 is configured to be overwrapped with the second blank 1500, for example, substantially as described with respect to FIGS. 5 and 6.

The first blank 1501 is configured to wrap three times around the whole circumference of the rod articles, with a small further wrapping to provide an overlap and secure the layers as tubes. The first blank 1501 is wrapped with the right edge as shown initially attached to the rod articles. In particular, the right edge is affixed to the rod articles, and the first blank 1501 wrapped continuously over three times around the rod articles. The second blank 1500 is affixed as a separate wrap, after wrapping of the first blank 1501. The second blank 1500 extends one time only around the whole circumference, with a small further wrapping to provide an overlap and secure the layer as a tube.

The first blank 1501 comprises a support section 1520 with an angled leading edge 821, substantially as described in FIG. 8. The first blank 1501 comprises connected first and second spacing sections 1510*a*, 15100*b*, substantially as described in FIG. 8. The first and second spacing sections 1510*a*, 15100*b* are connected by a spacer section 824. The spacer section 824 has a trailing edge 826 which is angled to a longitudinal axis of the smoking article, when wrapped, also as described with respect to FIG. 8. The first and second spacing sections 1510*a*, 15100*b* extend circumferentially over all three layers of the first blank 1501.

The first blank 1501 comprises a control element 1550. The control element 1550 controls ventilation as described with respect to the control element 550;950 shown in FIG. 5 or 9. The control element 1550 comprises first and second limiting surfaces 1553*a*, 1553*b* at the edges of the control element in the axis of movement, i.e. at the circumferential edge of the control element 1550, as described above. Contact of the first and second limiting surfaces 1553*a*, 1553*b* of the control element 1550 between a first engaging surface 1533*a* (as shown) and a second engaging surface 1533*b* defining a channel 1539 therebetween which limits relative rotation between the first and second parts. The first and second engaging surfaces 1533*a*,1533*b* and first and second limiting surfaces 1553*a*, 1553*b* are as described in any embodiment, and for example, can be angled as described with respect to FIG. 9.

The control element 1550 is a part of a control element support section 1536. The control element support section 1536 is arranged on the blank 1501 to form a second (middle) layer when wrapped around the rod articles. The control element 1550 is a part of a section on the same layer which extends at least once around the whole circumference of the rod articles. The control element support section 1536 extends around at least one, or at least two, or at least three whole circumferences of the smoking article. As shown, the control element support section 1536 extends over three whole circumferences of the rod articles. In some aspects, the control element support section 1536 comprising the control element 1550 is integral with one of the spacing sections, i.e. second spacing section 15100*b*. The control element support section 1536 can be considered as the same section of the blank 1501 as the second spacing section 15100*b*.

An outer layer of the first blank 1501 comprises an overlying section 1514. The overlying section 1514 is configured to allow the control element 1550 to move (i.e. rotate) underneath, to vary ventilation. The overlying section 1514 comprises a ventilation area 1572. The ventilation area 1572 is configured to coincide with the control element 1550 and/or channel 1539, and is arranged and functions as described in any other embodiment.

The control element support section 1536 is configured to attach to the first part of the smoking article. For example, the control element support section 1536 is affixed to the first filter section 112. The first spacing section 1510*a* is also affixed to the first filter section 112. As a part of the first part of the smoking article, the control element support section 1536 is in a fixed relationship with the first indexing surface on the rod article (first filter section). The second indexing surface (pawl) 304 is a part of the second part of the smoking article, and is movable relative to the control element support section 1536 and control element 1550, substantially as described with respect to FIG. 9.

The blank 1500 further comprises a rear section 1534 which extends longitudinally rearward of the control element support section 1536 on all three of the inner, middle and outer layers. The rear section 1534 has an edge adjacent to the control element support section 1536 which is profiled in a longitudinal direction. In particular, the rear section 1534 has a forward edge which defines the first engaging surface 1533*a* and second engaging surface 1533*b*, and defines the channel 1539, for example, in the middle layer of the wrapped blank 1501.

The rear section 1534 also defines an auxiliary channel 1549 in the inner layer of the wrapped blank 1501. The auxiliary channel 1549 has substantially the same circumferential and/or longitudinal extent as the channel 1539. The auxiliary channel 1549 is coincident with the channel 1539 when the blank is wrapped. As such, the edges of the auxiliary channel define circumferential edges 1543*a*,1543*b* which are coincident with the first and second engaging surfaces 1533*a*, 1533*b*. Thus, the first and second engaging surfaces 1533*a*, 1533*b* can be considered as extending radially over two layers of the smoking article. The auxiliary channel 1549 does not affect ventilation, and ventilation is controlled by selective covering of one or more of the ventilation areas 1572,1570 on the outer layer of the blank 1501 and on a rod article. The channel and auxiliary channel 1539, 1549 define a boundary between the control element support section 1536 and section 1534. Ventilating air can pass through the channel 1539 and coincident auxiliary channel 1549. Any feature of the channel of this embodiment or any other is also applicable to the auxiliary channel 1549.

In this example, the blank 1501 extends longitudinally around the first and second filter sections 112,114, and in particular, over the whole longitudinal length of the first and second filter sections 112,114. The blank 1501 does not extend around the tobacco rod 111.

The control element support section 1536 is attached to the rear section 1534 by a first frangible connection 1526, 1526*a*. The first frangible connection 1526,1526*a* extends over the inner and middle layers. The second indexing surface support section 1520 is connected to the control element support section 1536/second spacing section 15100*b* by a second frangible connection 1527. The second indexing surface support section 1520 is connected to the first spacing section 1510*a* by a third frangible connection 1528. Each of the first, second and/or third frangible connections extends substantially circumferentially when wrapped. Each of the first, second and/or third frangible connections is formed by perforations in the sheet material of the blank 1501.

The second blank 1500 comprises a ventilation area 1574 arranged to coincide with the ventilation areas 1570, 1572 and channels 1539,1549. The ventilation area 1574 extends over the whole circumference of the second blank 1500, such that the ventilation area 1574 does not directly determine the effective ventilation of the smoking article with a variation in positioning of the control element 1550. The ventilation area 1574 comprises a plurality of discrete ventilation areas in a circumferential and/or longitudinal direction.

The second blank comprises a fourth frangible connection 1530, extending circumferentially, providing for separation of the second blank 1500 into a forward area 1580 and a rearward area 1582. The forward area 1580 is affixed to the first spacing section 1510*a* only. The rearward area 1582 is affixed to the support section 1520, and the section 1534. The rearward area 1582 extends over, but is not affixed to, the control element support section 1536 or second spacing section 15100*b*. The rearward area 1582 functions to connect the support section 1520 and rear section 1534. The rear section 1534 is affixed to the second filter section, and the control element support section 1536 is longitudinally fixed between first and second spacing sections. Thus, the second blank 1500 provides a connection between the second filter section and the first filter section. The connection maintains the first and second filter sections in a fixed longitudinal relationship (e.g. adjacent to each other), whilst allowing relative rotation. In common with other embodiments, the outermost or exterior layer of the blank(s) wrapped around the first and second filter sections 112,114 provides the, or the only, connection between the first and second filter sections 112,114.

The rearward area 1582 of the second blank 1500 defines an outer mouth end part of the smoking article. Rotation of this outer mouth end part relative to the tobacco rod effects movement between the first and second parts of the smoking article. In particular, the second filter section 114, rear section 1534 and second indexing surface 304 rotate together. Thus, the first and second engaging surfaces 1533*a*, 1533*b* and ventilation areas 1570,1572 rotate together with the second filter section. The second indexing section indexes with the first indexing section on the first filter section. The control element 1550 remains in a fixed relation with the tobacco rod, and so relative to the tobacco rod, the first and second engaging surfaces 1533*a*,1533*b* and ventilation areas 1570,1572 rotate relative to a stationary control element 1550. The effect is the same as described with respect to FIGS. 1 to 14, in that the control element 1550 selectively covers at least one of the ventilation areas 1570,1572 and limits rotation by engagement with the first and second engaging surfaces 1533*a*,1533*b*. The control element 1550 is a part of a section which extends at least once around the whole circumference of the rod articles. Thus, the embodiment of FIG. 15 functions in a similar manner to the other embodiments, although the control element 1550 and second indexing surface 304 on the first blank 1501 are movable relative to each other.

The first blank 1501 defines contacting surfaces configured to engage to limit or prevent longitudinal withdrawal of the second filter section 114. The contacting surfaces are provided by a forward edge of the control element support section 1536 and a rearward edge of the second indexing surface support section 1520. The adjacent contacting edges are initially an integral part of the same blank 1501. The contacting edges extend over one or more whole circumferences of the smoking article. In some examples, contacting edges extend over at least two times around the circumference of the smoking article.

Figure 16:
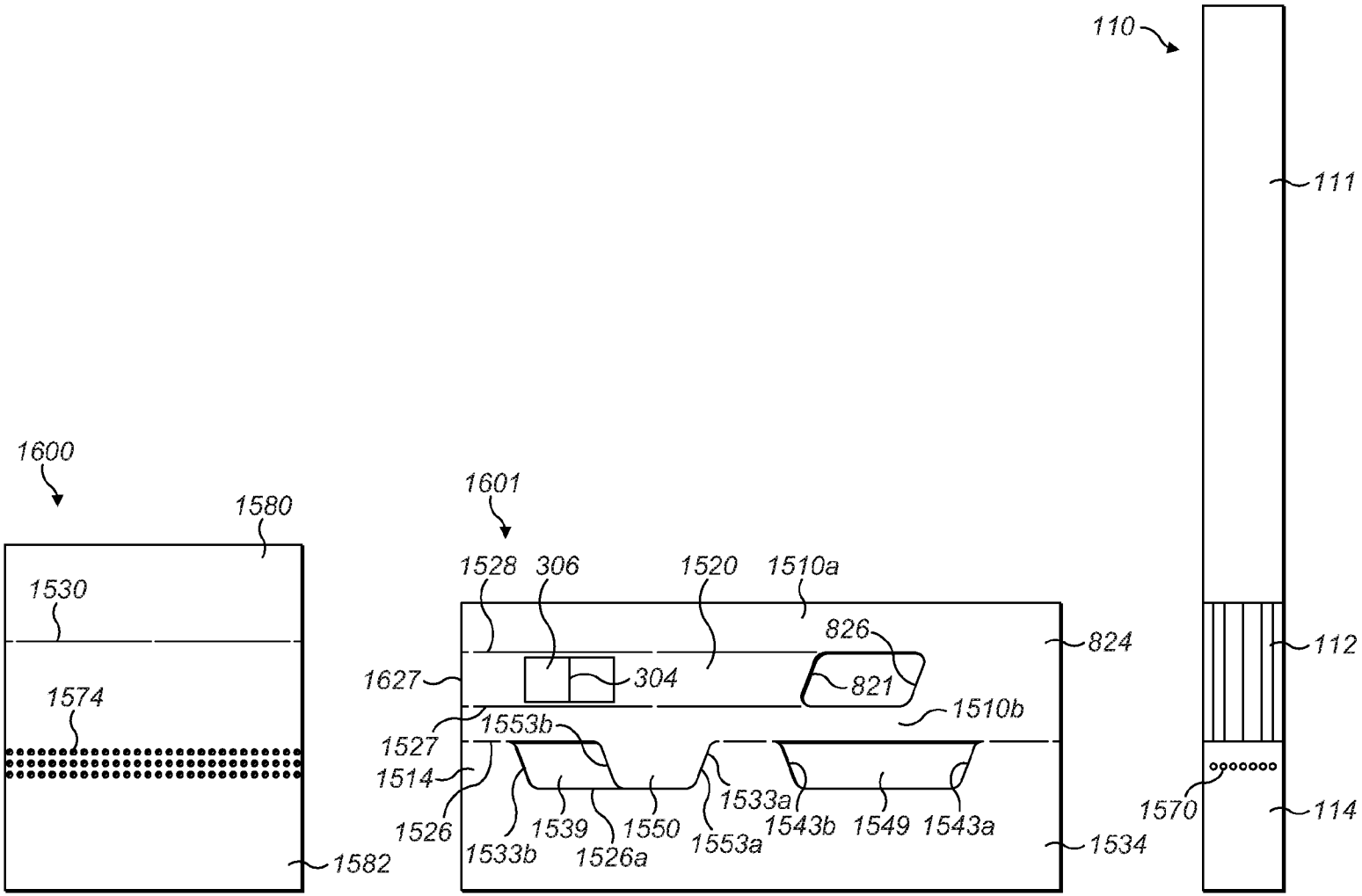
FIG. 16 is a plan view of blanks and rod articles according to a thirteenth embodiment of the smoking article.

FIG. 16 shows a further embodiment of a first blank 1601 and a second blank 1600, configured to be wrapped around one or more rod articles 110. The first blank 1601 is configured and functions in a similar manner to the embodiment described with respect to FIG. 15, and the same reference numerals are used to indicate the same parts. The blank 1601 differs by comprising only the inner and middle layers (first and second layers), as described with respect to the embodiment of FIG. 14. The first blank 1601 is configured to wrap two times only around the whole circumference of the rod articles.

The control element 1550 on first blank 1601 controls ventilation by the degree of overlap with the ventilation area 1570 on a rod article, e.g. second filter section 114. The ventilation area 1574 on the second blank 1600 does not directly affect ventilation. Thus, the only ventilation area with which the control element 1550 variably overlies to determine ventilation is on a rod article.

Alternatively, the second blank 1600 comprises a ventilation area which at least partially determines the ventilation of the smoking article. For example, the ventilation area on the second blank 600 can extend over only a part of the circumference, e.g., aligned with (or instead of) the ventilation area 1570. In some examples, the control element 1550 is movable relative to the ventilation area(s), the amount of overlap of control element 1550 blocking or covering a variable amount of the ventilation area(s) determining ventilation.

The ventilation area 1574,1570 of the second blank and/or in the rod article, can comprise a single aperture or a plurality of discrete apertures extending over a circumferential area. The area of the second blank and/or rod article around the ventilation areas 1570,1574 is substantially impermeable to air. Alternatively or in addition, the auxiliary channel 1549 can extend over less than the circumferential extent of the channel 1539, such that the inner layer of the wrap provides a ventilation area which determines the effective ventilation of the smoking articles, for example, as described in any embodiment above.

Figure 17:
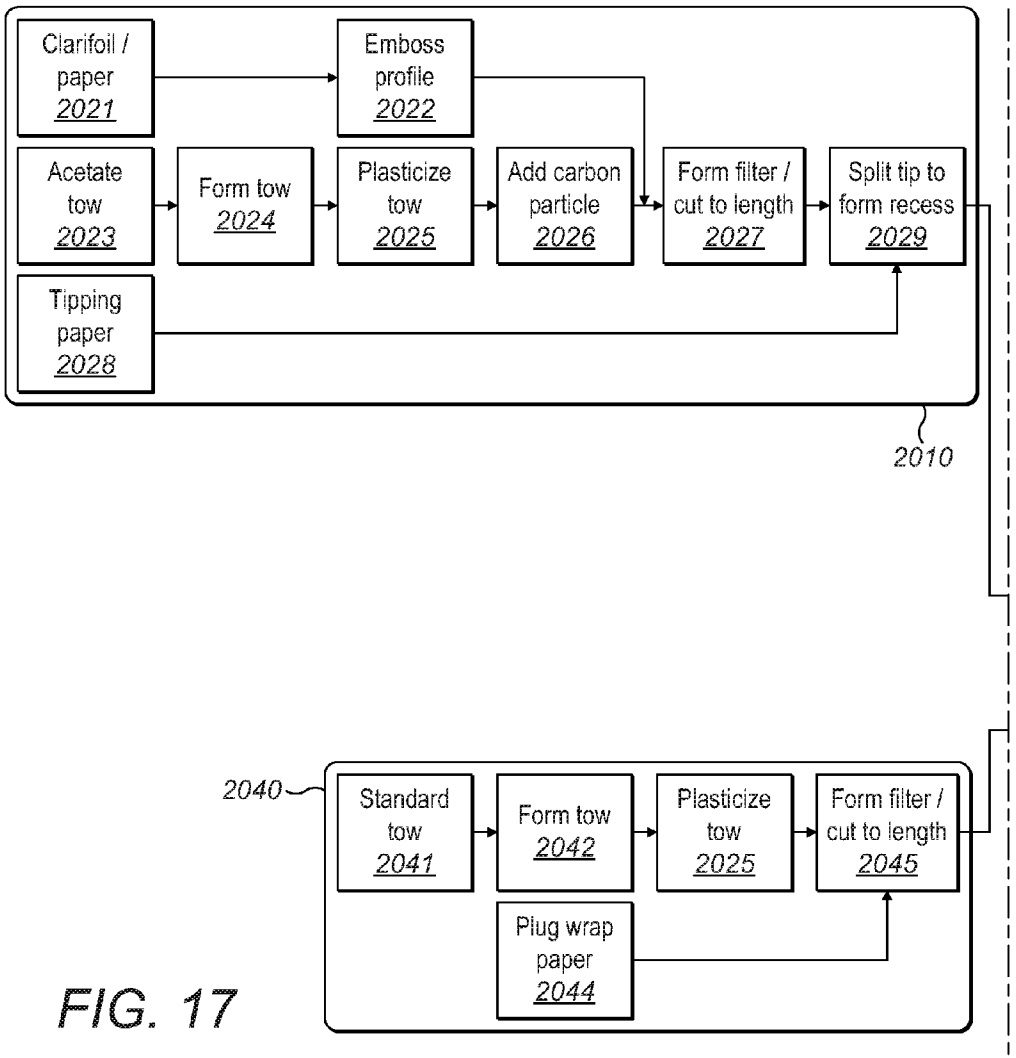
FIG. 17 is a schematic view of a first method of manufacturing a smoking article according to the present invention.
Figure 17:
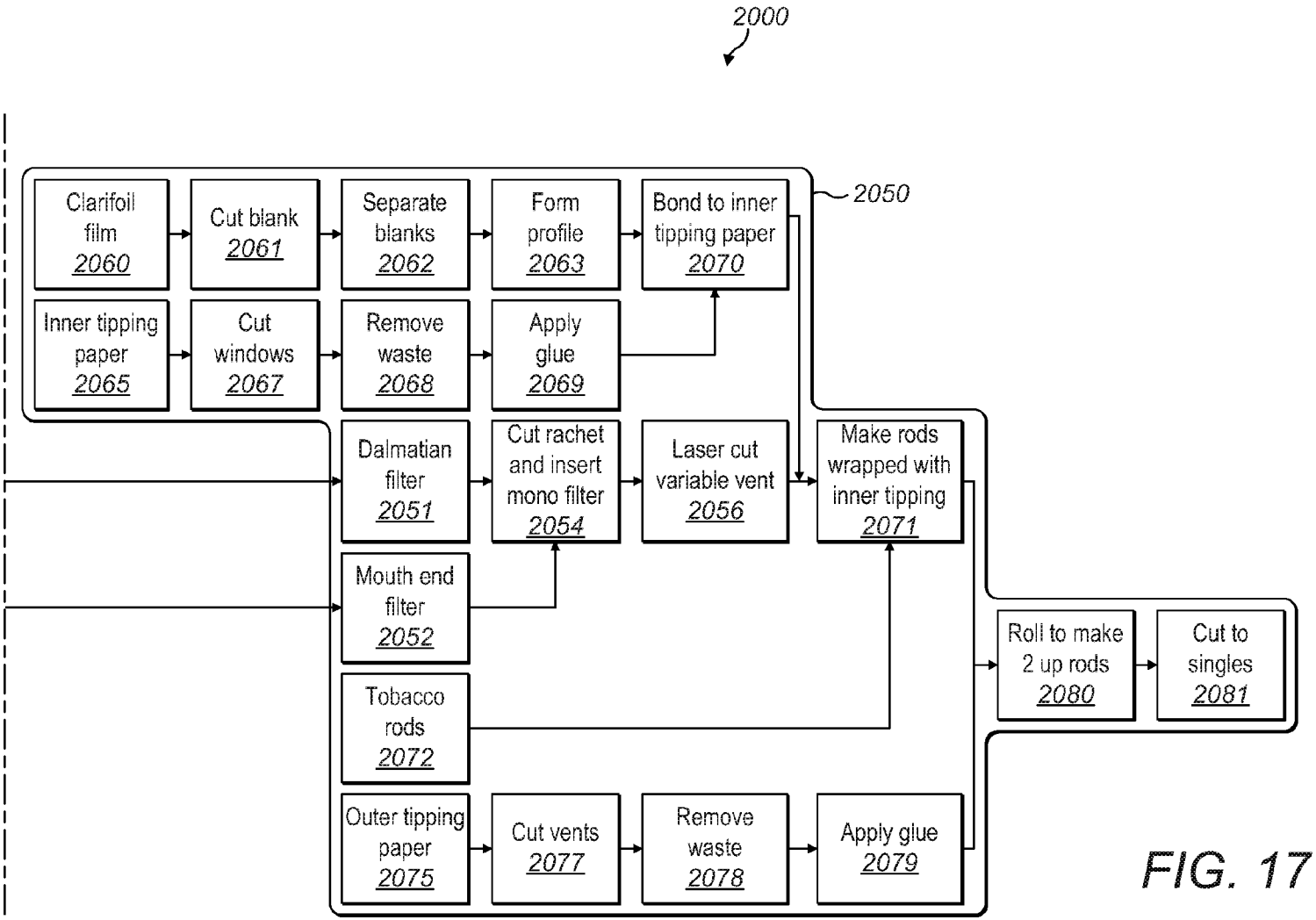
Figure 18:
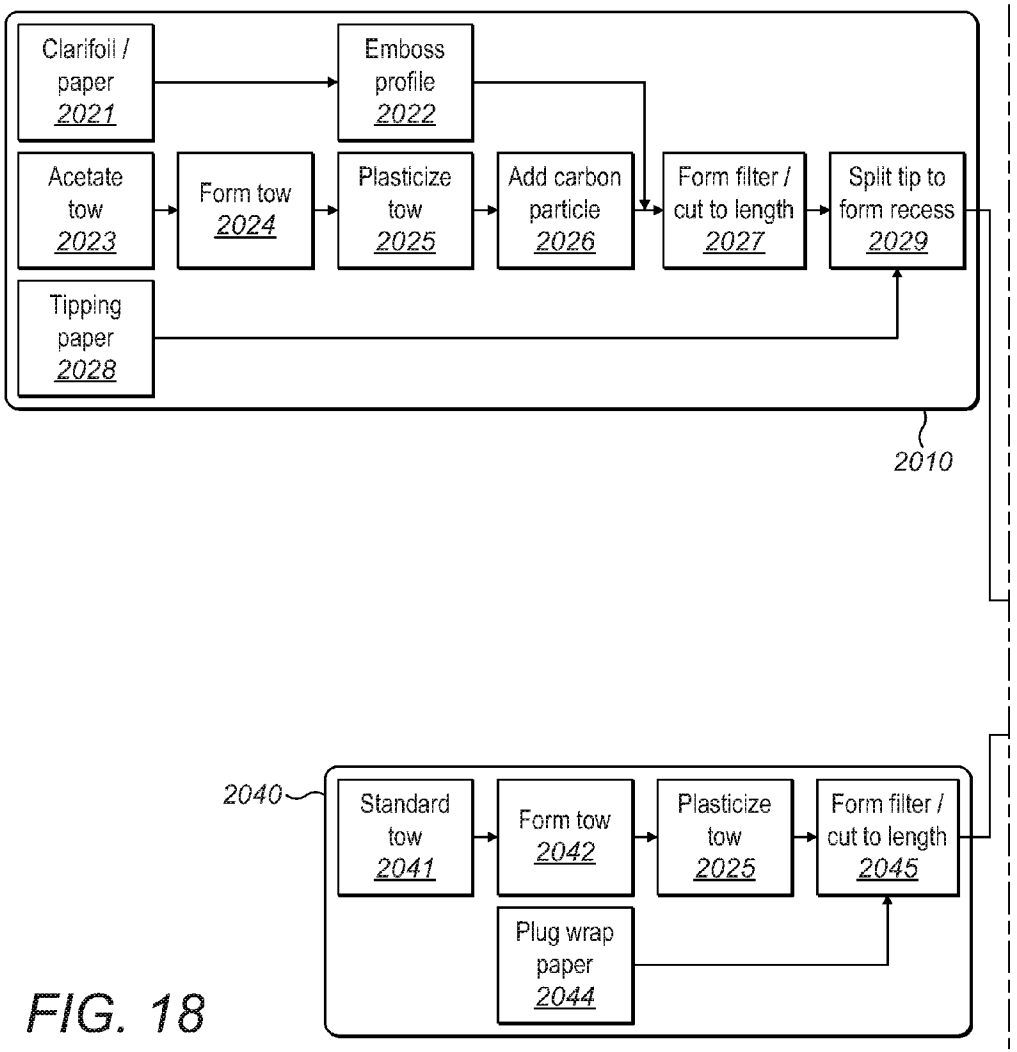
FIG. 18 is a schematic view of a second method of manufacturing a smoking article according to the present invention.
Figure 18:
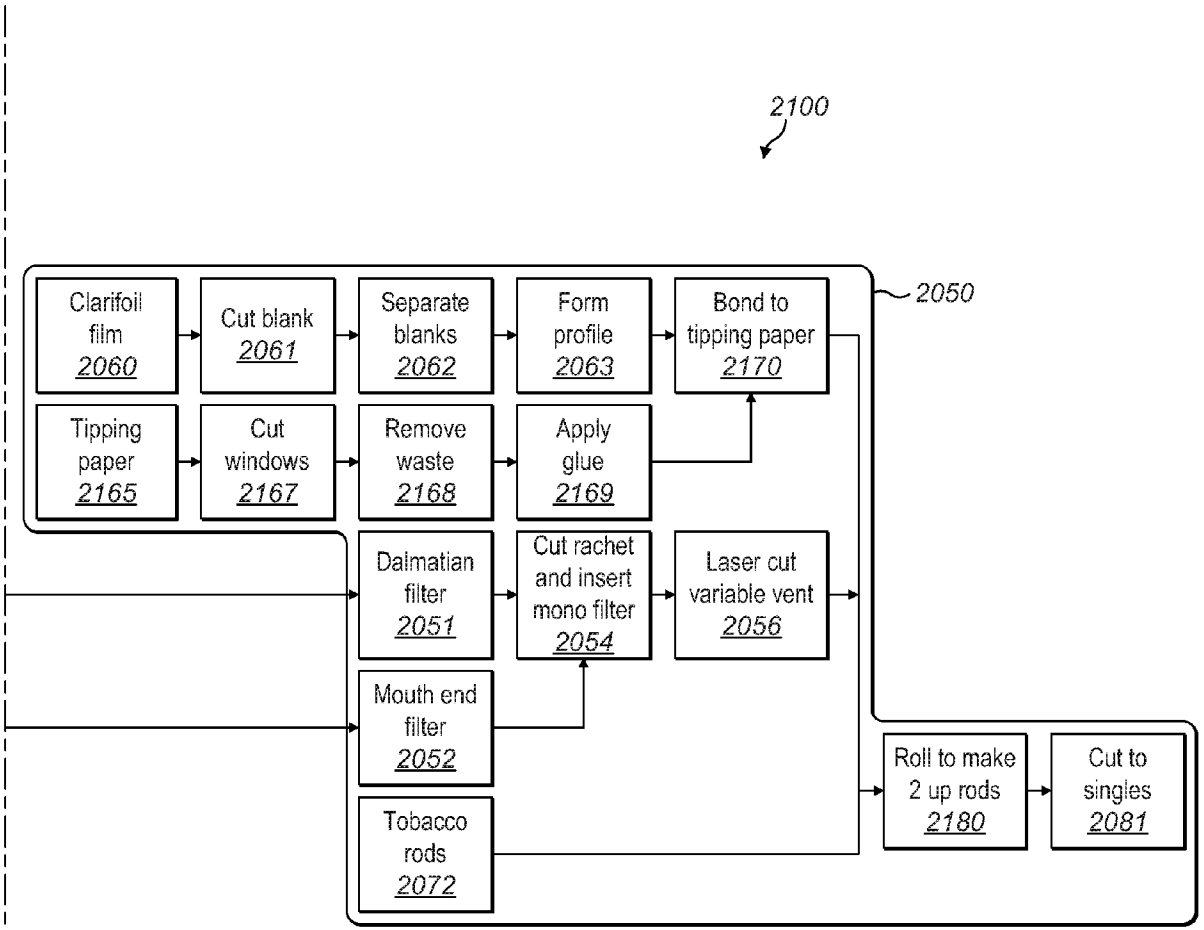
Figure 19:
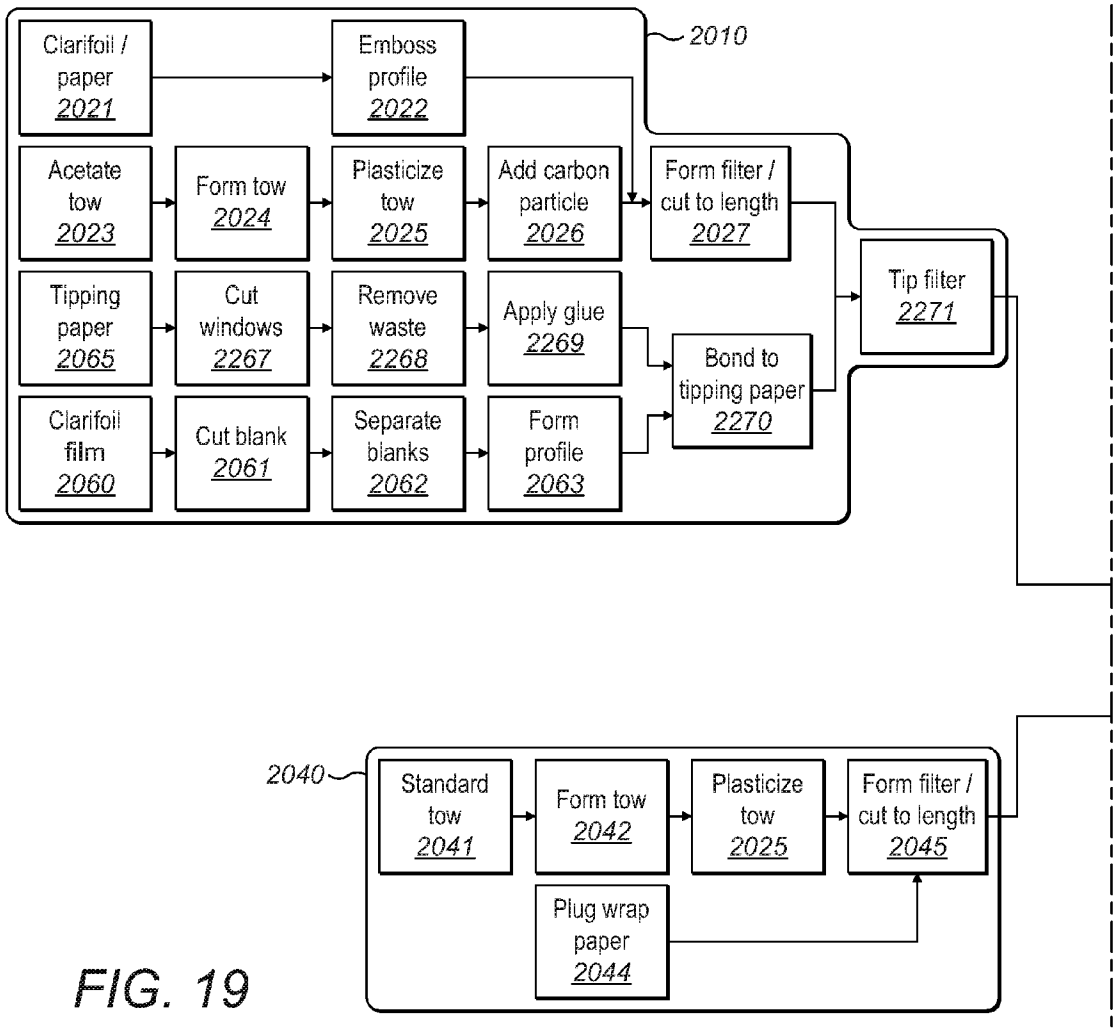
FIG. 19 is a schematic view of a third method of manufacturing a smoking article according to the present invention.
Figure 19:
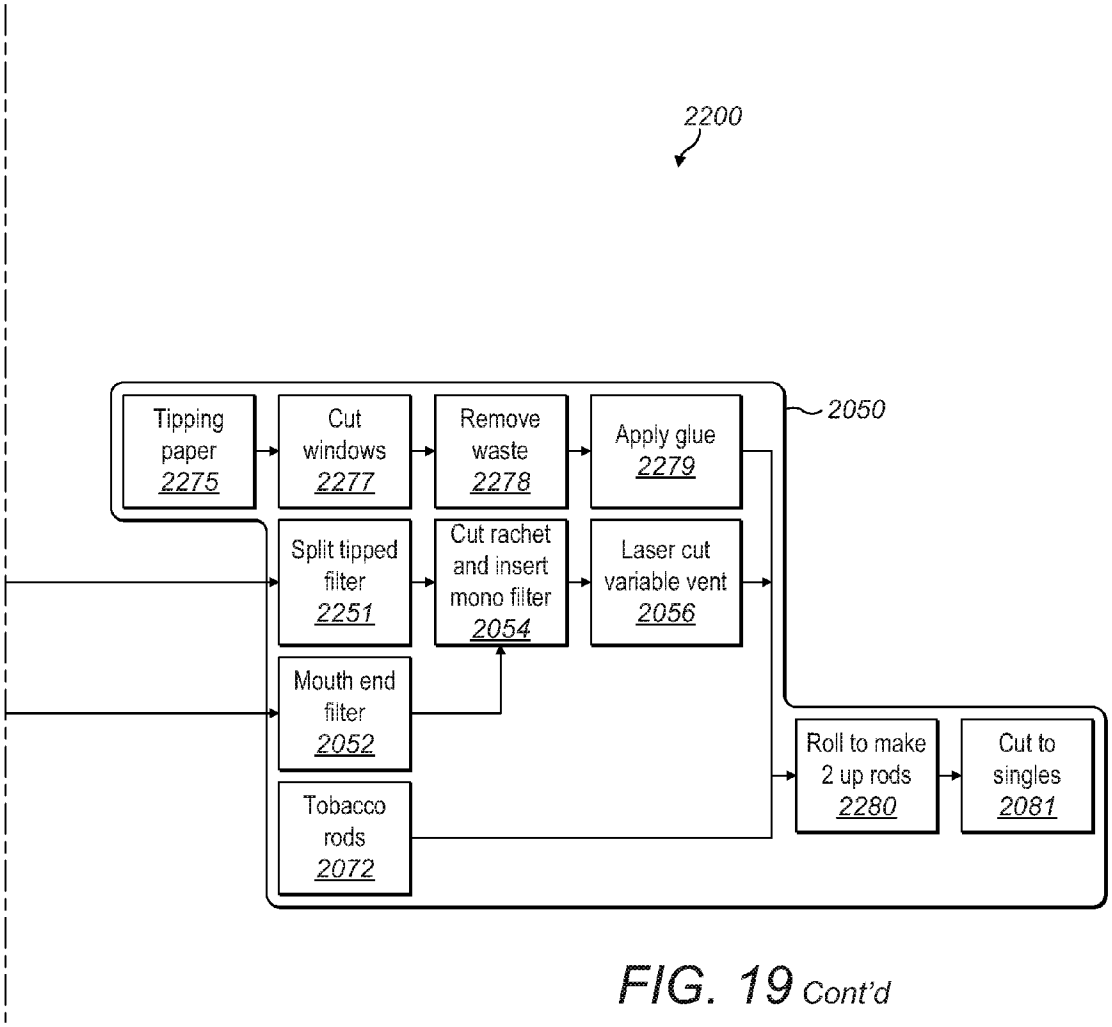

FIGS. 17 to 19 show exemplary processes in methods of manufacture. The terms used and processes illustrated are examples only. In general, a method of manufacturing a smoking article comprises providing one or more rod articles. In particular, the rod articles comprise a source of smokable material, a first filter section and a second filter section.

A first blank is wrapped around one or more of the rod articles, e.g. the first filter section. The first blank is dimensioned to wrap a plurality of times around the whole circumference (e.g. two times or three times) to provide an inner and outer tube. The first blank is provided with adhesive to adhere to the rod article and/or the inner layer.

A second blank is then wrapped around the rod articles and first blank. The first blank is dimensioned to wrap one or more times around the whole circumference (e.g. one time or two times) to provide one or more further tubes. The second blank is provided with adhesive to adhere to the rod articles and/or the inner layer and/or adhere to an inner layer of the second blank.

The rod articles and blank can be configured to manufacture one or more smoking articles simultaneously. For example, if two smoking articles are made simultaneously, a further step is to cut the dual article in half to provide two smoking articles.

FIG. 17 shows schematically a first method 2000 of manufacturing smoking articles according to the present invention. The method is related to the embodiment shown in FIG. 13, with differences explained below The smoking articles are assembled in assembly process 2050, using components formed in indexing section process 2010 and second filter process 2040. These processes are now described in turn. The processes may be configured to provide components which are suitable for manufacturing one, two or four smoking article simultaneously, and which are later cut to form individual smoking articles.

The indexing section process 2010 comprises forming a filter having a first indexing section 116. Indexing section process 2010 comprises providing a sheet material, for example, polymer film (e.g. cellulose acetate film, e.g. CLARIFOIL) or paper (2021), and embossing an indexing profile (2022) having grooves and ridges, for example using opposed rollers. The process 2010 further comprises providing a standard tow of filtration material (2023), for example cellulose acetate tow. The tow is formed into a cylinder (2024), and the tow plasticised (2025). Optionally, an adsorbent additive is added to the tow (2026), for example carbon particles. The adsorbent additive particles are distributed throughout the filtration material. The film with an indexing profile is wrapped around the tow to form a rod comprising a first filter section, and the rod is cut to length if necessary (2027).

In the method as shown, one or more spacing sections are provided (2028) wrapped around the first filter section (2029). The one or more spacing sections are spaced apart longitudinally.

Second filter process 2040 comprises providing conventional filtration material (2041), for example in the form of cellulose acetate tow. The tow is formed into a cylinder (2042). The tow is plasticised with a plasticiser (2043). A sheet material is provided, for example, paper plugwrap (2044). The filtration material is wrapped with the sheet material, and a continuous rod of wrapped filtration material is cut into pieces for forming one or a plurality of second filter sections (2045).

The assembly process 2050 receives the first filter having a first indexing surface (2051) from process 2010. A double-length first filter section is provided, having a first indexing surface (i.e. ratchet) and cut in half (2054). The assembly process 2050 comprises providing standard second filter sections from process 2040 (2052). Two of the second filter sections (for example a double length second filter) are inserted between the separated first filters (2054). The second filter sections can be a plain cellulose acetate filter, e.g. with no additive. One or more variable ventilation apertures are formed in the second filter sections, for example with a laser (2056).

The assembly process 2050 further comprises providing a pawl unit comprising a pawl forming the second indexing surface. The pawl unit is formed by providing a sheet material e.g. cellulose acetate film (2060), from which is cut a blank (2061). The blanks are separated (2062), and folded, for example by rollers to form a pawl profile e.g. a triangular upstanding pawl (2063).

An inner sleeve or wrap is formed by providing sheet material (2065), for example tipping paper. One or more ventilation apertures are cut in the blank (2067), and the material of the apertures is removed as waste (2068). The blank may be formed to provide sleeves for two smoking articles. An adhesive is applied to the blank (2069).

The pawl unit is affixed to the inner sleeve blank (2070) by the adhesive. In some aspects, two pawl units are affixed to each double length sleeve blank. In 2071, the sleeve blank is located around the first and second filter sections and with the pawl registered between the spacing sections (2071). The sleeve blank also extends around tobacco rods provided in 2072, and located adjacent the first filter sections.

In some examples, an outer sleeve blank or wrap is formed by providing sheet material (2075), for example tipping paper. One or more ventilation apertures are cut in the blank (2077), and the material of the apertures is removed as waste (2078). The blank may be formed to provide sleeves for two smoking articles. An adhesive is applied to the blank (2079). The outer tipping paper and inner tipping paper can be integral in some aspects of the invention.

The sleeve blanks are secured as cylinders around the inner wrap, first and second filters and tobacco rods to form a double length smoking article (2080). The double length second filter is cut laterally to form two individual smoking articles (2081).

The method described can be modified to combine or alter the process steps to manufacture a smoking article according to any of the embodiments described.

FIG. 18 shows schematically a second method 2100 of manufacturing smoking articles according to the present invention. The method is related to the first method shown in FIG. 17, and the same steps are numbered identically. The second method can also relates to the embodiment shown in FIG. 13, with the differences explained below.

A sleeve or wrap blank is formed by providing sheet material (2165), for example tipping paper. The wrap is dimensioned to form two (or more layers) around the rod articles 110. One or more ventilation apertures are cut in the blank (2167), and the material of the apertures is removed as waste (2168). The blank may be formed to provide sleeves for two smoking articles. An adhesive is applied to the blank (2169).

In 2170, the pawl formed in 2063 (described above) is attached to the blank. For example, the pawl is attached with adhesive. The pawl is positioned on the blank to be on an inner layer of the blank, when wrapped around the rod articles 110.

In 2180, the blank is wrapped around the rod articles two or more times to form two or more layers of sheet material. The wrapping of the blank also connects a tobacco rod to the first filter section. Alternatively, the tobacco rod is attached by a separate blank wrapped around the tobacco rod and first filter section.

FIG. 19 shows schematically a third method 2200 of manufacturing smoking articles according to the present invention. The method is related to the first method shown in FIG. 17, and the same steps are numbered identically.

An inner blank for a sleeve or wrap is formed by providing sheet material (2265), for example tipping paper. The inner wrap (i.e. first blank) is dimensioned to form two (or more layers) around the rod articles 110. One or more ventilation apertures are cut in the blank (2267), and the material of the apertures is removed as waste (2268). The blank may be formed to provide sleeves for two smoking articles. An adhesive is applied to the blank (2269).

In 2270, the pawl formed in 2063 (described above) is attached to the blank. For example, the pawl is attached with adhesive.

An inner sleeve or wrap is formed by providing sheet material (2165), for example tipping paper. The inner wrap is dimensioned to form two (or more layers) around the rod articles 110. One or more ventilation apertures are cut in the blank (2167), and the material of the apertures is removed as waste (2168). The blank may be formed to provide sleeves for two smoking articles. An adhesive is applied to the blank (2169).

In assembly process 2050, an outer sleeve or wrap is formed by providing sheet material (2275), for example tipping paper. The inner wrap is dimensioned to form two (or more layers) around the wrapped first filter section. One or more ventilation apertures are cut in the blank (2277), and the material of the apertures is removed as waste (2278). The blank may be formed to provide sleeves for two smoking articles. An adhesive is applied to the blank (2279).

In 2280, the blank is wrapped around the wrapped first filter section two or more times to form two or more layers of sheet material. The outer wrap is arranged to engage to be secured with an exterior surface of a section supporting the pawl, the pawl being engaged with the first indexing surface of the first filter section.

In any embodiment, the control element extends over only a part of a circumference of the smoking article. Thus, rotation of the control element can cover a ventilation aperture.

The control element is integrally attached to the control element support section. The attachment is not by folding the control element to overlie or underlie the support section. The control element is in the same radial layer as the control element support section. The blanks of embodiments of the invention have a further radial layer can be initially integrally formed with the layer of the control element and support section. Alternatively, a separate radial layer can be wrapped around the control element and support section.

The movement of the selection portions relative to the underlying layer has been described as a rotational movement. Alternatively, the movement is a longitudinal movement, i.e. along a longitudinal axis of the rod articles or smoking articles. Alternatively, the movement is a combination of longitudinal and rotational movement.

The limiter has been described as comprising a stop integrally formed with the inner wrap. Alternatively, the stop comprises a raised protrusion of any type, movable within a slot. For example, the stop is formed by adhesive, forming a raised protrusion. The stop extends radially outwardly from the rod articles, into the slot of any embodiment. In some examples, the stop is connected to both the outer wrap and the rod articles. In an alternative arrangement, the stop extends through the slot in the inner layer, and attaches to both radially adjacent layers, i.e. to both the outer layer and the rod articles forming the first part of the smoking article. The outer wrap and the rod articles form a single unit, between which the inner wrap is rotatable. The stop provides a connection between the outer wrap and the tobacco unit. The stop 272 may be formed only of adhesive, adhered to both the outer wrap and the tobacco unit. The attachment of the stop 272 to both radially adjacent layers means that the stop 272 cannot be moved out of the slot 271, for example, by a radial deformation of the inner wrap 113 defining the slot 271. Alternatively, the slot is formed in the outer wrap, and the stop movable within the slot is attached to the inner wrap.

Embodiments of the invention are described in which a plurality of layers wrapped around the rod articles are integrally formed, i.e. the same blank provides a plurality of layers. Alternatively, one or more of the layers described can be formed by a separate blank, i.e. one or each layer is wrapped separately. In addition, any of the layers which are described as formed by wrapping a separate blank can be formed integrally with any other adjacent layer. Any adjacent layer of the smoking article can be integrally formed with any one or more adjacent layers.

In some examples, the second filter section is any type of section which provides support for the surrounding wrap(s). For example, the second filter section can be a hollow cylindrical tube. Alternatively, the smoking article does not comprise a second filter section movable relative to the source of smokable material. The second part of the smoking article comprises an exterior part which is movable relative to another exterior part, in order to modify a property of the smoking article, substantially as described. In this case, a filter section is not connected to one of the movable external parts.

The sections of blank of any embodiment have been described as comprising one or more frangible connections. Alternatively, the blank does not comprise one or more of those frangible connections. Instead, the sections are separated by cutting the blank prior to, or after, wrapping around the rod articles. For example, the blank could be cut when wrapped around the rod articles by a rotary knife or laser.

The control element and the channel in which the control element is movable have been shown in each embodiment. Alternatively, the control element and the channel can be reversed, i.e. the section defining the control element instead defines the channel, and the section defining the channel defines the control element. The control element is still movable within the channel, and the overall function is substantially the same. Minor modifications may be needed to provide for the same functioning.

Any embodiment can comprise both a variable ventilation and a base ventilation. The base ventilation can be provided by ventilation areas, e.g. apertures, extending through all layers of the blank(s) and optionally, in the wrap around the rod articles. For example, the second filter section can comprise a base ventilation area. A variable ventilation area can be formed in the first or second ventilation area. The variable ventilation area can have a partial circumferential extent which can be selectively covered by the control element to determine the ventilation, or extend around the circumference such that the position of the aligned control element does not determine ventilation by covering that ventilation area.

The first and second part of the smoking article have been described as moving in indexed steps. Alternatively, the smoking article does not comprise an indexing mechanism, and the first and second part of the smoking article do not move in indexed steps. The first and second parts are movable continuously. The range of movement can be limited by the control element, e.g. as described above. A rotational position of the control element relative to at least one ventilation area is not indexed, e.g. the position is continuously selectable. In some examples, the selected position is retained by friction between adjacent layers which are movable relative to each other. This embodiment can comprise the second blank 900, as described with respect to FIG. 9. The blank 900 is wrapped directly around one or more rod articles. The rod articles comprise one or more filter sections. The rod articles may not comprise a first indexing surface.

In some examples, the smoking article does not comprise the first blank 901. The blank 900 can be provided with a cut-out, i.e. an aperture in the blank 900, e.g. adjacent the control element support section. The cut-out is configured such that the control element support section is movable into the cut-out. Thus, the cut-out allows for an initial movement of the control element support section, e.g. in a circumferential direction. The cut-out provides a space in the same layer as the control element support section, into which the control element support section is movable. The cut-out is configured to prevent a circumferential edge of the control element support section catching on (or contacting) an adjacent part of the blank 900 when rotated. This configuration can allow reliable movement between the first part and second part of the smoking article. A cut-out adjacent, e.g. circumferentially adjacent, to a movable part of the blank, e.g. control element support section, can be included in any embodiment to allow initial movement.

The spacing sections are configured to extend one or more times around the circumference of the rod articles, e.g. one or more times around the whole circumference of the rod articles. Various embodiments describe one or more spacing sections extending twice around the rod articles, in some aspects, forming an inner and an outer complete layer. Alternatively, the one or more spacing section(s) extend only one time around the whole circumference of the rod articles. In addition, in some aspects, an overlap of the spacing section is affixed to itself to secure the spacing sections as a tube around the rod articles. The single layer of spacing section can be connected or frangible connected to a control element support section. In this case, the connection (to be cut or frangible) extends around the whole circumferential length of the or each spacing section(s).

Any of the features described can be claimed independently of any other feature. For example, the feature of the interface between the first and second parts being longitudinally offset on the different layers can be claimed independently. In particular, the interface is offset on two layers which are integral. The first and second layers are wrapped as a single blank around the rod articles. In some aspects, the contacting surfaces limiting or preventing longitudinal movement can also be claimed independently.

In order to address various issues and advance the art, the entirety of this disclosure shows by way of illustration various embodiments in which the claimed invention(s) may be practiced and provide for superior smoking articles or manufacturing of smoking. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smoking article, comprising:

a first engagement surface and a second engagement surface spaced apart circumferentially, a controller movable between the first and second engagement surfaces, and a ventilation area configured to be selectively covered by the controller, the controller having a first limiter edge configured to engage with the first engagement surface and a second limiter edge configured to engage with the second engagement surface to define a range of rotational movement, the controller substantially impermeable to ventilating air between the first limiter edge and the second limiter edge, a region of the controller between the first limiter edge and the second limiter edge arranged to selectively cover the ventilation area, the smoking article configured such that:

a relative circumferential position of the controller between the first and second engagement surfaces determines a ventilation level of the smoking article, and an amount of the ventilation area covered by the region of the controller directly determines the ventilation level of the smoking article.

2. The smoking article as claimed in claim 1, wherein the controller and the first and second engagement surfaces are defined on a same sheet of material, the smoking article having defined therein one or more frangible connections to separate the controller from a section defining the first and second engagement surfaces.

3. The smoking article as claimed in claim 1, wherein the controller and/or the first and second engagement surfaces are defined on a sheet of material arranged in a plurality of layers that extend around a whole circumference of the smoking article.

4. The smoking article as claimed in claim 1, further comprising: a plurality of contact surfaces configured to limit or prevent longitudinal movement between the controller and the first and second engagement surfaces.

5. The smoking article as claimed in claim 4, wherein the plurality of contact surfaces are disposed around substantially the whole circumference of the smoking article.

6. The smoking article as claimed in claim 4, wherein one of the plurality of contact surfaces is defined by a support section attached to the controller.

7. The smoking article as claimed in claim 1, further comprising a first layer and a second layer disposed around a circumference of the smoking article, the first layer and the second layer each including a forward part moveable relative to a longitudinally adjacent rearward part, wherein a first interface is defined between the forward and rearward movable parts on on the first layer and a second interface is defined between the forward and rearward moveable parts on the second layer, and at least part of the first interface is not aligned with the second interface.

8. The smoking article as claimed in claim 1, having defined therein one or more frangible connections to separate the controller from a section defining the first and second engagement surfaces.

9. The smoking article as claimed in claim 1, further comprising an indexer, the controller being movable between discrete positions provided by the indexer to select one of a plurality of discrete ventilation levels.

10. The smoking article as claimed in claim 9, further comprising a rod article, the indexer including a first index surface defined in an exterior surface of the rod article and a second index surface including one or more protrusions movable between one of a plurality of features of the first index surface.

11. The smoking article as claimed in claim 10, further comprising a plurality of rod articles, the indexer including a tube extending around a circumference of a rod article of the plurality of a rod articles and movable around said rod article, and the tube including or supports the second index surface on an interior of the tube.

12. The smoking article as claimed in claim 1, further comprising a support section, the controller being disposed longitudinally beyond the support section.

13. The smoking article as claimed in claim 1, further comprising a support section attached to the controller and disposed around a whole circumference of the smoking article.

14. The smoking article as claimed in claim 1, wherein the controller includes an area of material disposed longitudinally beyond an integral support section, the integral support section disposed in the same radial layer as the controller.

15. The smoking article as claimed in claim 13, wherein the controller is disposed on a longitudinally rearward side of the attached support section.

16. The smoking article as claimed in claim 1, wherein the controller is configured to overlie, and control ventilation into, a rod article at a mouth end of the smoking article.

17. The smoking article as claimed in claim 1, further comprising: a rod article, a first layer, a second layer radially spaced from the first layer, and a third layer extending around the rod article, the first layer including a first ventilation area and the third layer including a second ventilation area at last partially aligned with the first ventilation area, the controller on the second layer movable between the first and second layers such that the controller is movable relative to the first and second ventilation areas to select a level of ventilation.

18. The smoking article as claimed in claim 1, wherein;

the controller is defined on one or more first layers of a plurality of integrally formed layers around one or more rod articles and the ventilation area is defined on one or more second layers of said plurality of integrally formed layers, wherein the first layer and the second layer are separable from one another, and/or the smoking article further comprises a further part, overlying the controller and the first and second engagement surfaces, and defining an exterior surface of the smoking article.

19. The smoking article as claimed in claim 10, further comprising at least one spacer section disposed one or more times around a circumference of the smoking article, the at least one spacer section configured to maintain a radial position of the second index surface relative to the first index surface.

20. The smoking article as claimed in claim 19, further comprising a second index surface support section configured to define or support the second index surface, and the second index surface support section is in a same radial layer as the at least one spacer section, the second index surface support section and the at least one spacer section being separable from each other.

21. The smoking article as claimed in claim 1, further comprising a rod article, at least one spacer section attached to the rod article of the smoking article and a support section movable relative to the spacer section, wherein:

the controller is connected to the support section, and/or the controller overlies the at least one spacer section.

22. The smoking article as claimed in claim 21, further comprising a section overlying the at least one spacer section and configured to support the second index surface in a pre-determined radial position relative to the first index surface defined at least partially by the at least one spacer section.

23. The smoking article as claimed in claim 1, wherein the controller and the first and second engagement surfaces are formed on a same layer of sheet material wrapped around one or more rod articles, the smoking article having defined therein one or more frangible connections to separate the controller from a section defining the first and second engagement surfaces.

24. The smoking article as claimed in claim 1, further comprising:

a first part including a source of smokable material, a second part including a filter section and configured to rotate relative to the first part, a first index surface on the first part and a second index surface on the second part, configured to engage to index the rotation between the first and second parts, one of the first or second parts including the controller configured to control a ventilation of the smoking article, and a ventilation area in the other of the first or second parts of the smoking article from the controller, said ventilation area configured to be selectively covered by the movable controller, the second part further including a connector section connecting the filter section to the first part of the smoking article, and the connector section being affixed to or supporting the second index surface.

25. The smoking article as claimed in claim 1, further comprising one or more rod articles, a first layer, a second layer and a third layer, the first, second and third layers disposed around the one or more rod articles, the first layer including a first spacer section disposed around a circumference of one of said one or more rod articles, the second layer including the controller, first and second engagement surfaces, and a second index surface configured to engage with a first index surface on a rod article of the one or more rod articles, and the third layer including the ventilation area configured to be selectively covered by the controller.

26. The smoking article as claimed in claim 6, wherein the contact surface is on an opposite longitudinal side of the support section to the controller.

27. The smoking article as claimed in claim 7, wherein substantially a whole circumference of the first interface is longitudinally spaced from the second interface.

28. The smoking article as claimed in claim 16, wherein the controller is further configured to overlie and control ventilation into a filter section movable relative to a source of smokable material.

29. The smoking article as claimed in claim 20, wherein the second index surface support section and at least one spacer section are initially integrally attached and are configured to be separable from each other.

* * * * *